US008168877B1

(12) United States Patent
Rutledge et al.

(10) Patent No.: US 8,168,877 B1
(45) Date of Patent: May 1, 2012

(54) MUSICAL HARMONY GENERATION FROM POLYPHONIC AUDIO SIGNALS

(75) Inventors: Glen A. Rutledge, Brentwood Bay (CA); William Norman Campbell, Delta (CA); Peter R. Lupini, Victoria (CA)

(73) Assignee: Harman International Industries Canada Limited, Victoria, BC (CA)

( * ) Notice: Subject to any disclaimer, the term of this patent is extended or adjusted under 35 U.S.C. 154(b) by 811 days.

(21) Appl. No.: 11/866,096

(22) Filed: Oct. 2, 2007

Related U.S. Application Data

(60) Provisional application No. 60/849,384, filed on Oct. 2, 2006.

(51) Int. Cl.
*G10H 1/38* (2006.01)
*G10H 1/18* (2006.01)

(52) U.S. Cl. ..... 84/613; 84/616; 84/637

(58) Field of Classification Search ..... 84/610, 84/613, 616, 622, 625, 634, 637, 645, 650, 84/660

See application file for complete search history.

(56) References Cited

U.S. PATENT DOCUMENTS

| | | | | | |
|---|---|---|---|---|---|
| 4,817,484 | A * | 4/1989 | Iba et al. | ..... | 84/735 |
| 5,223,659 | A * | 6/1993 | Shiraki et al. | ..... | 84/669 |
| 5,523,526 | A * | 6/1996 | Shattil | ..... | 84/728 |
| 5,712,437 | A * | 1/1998 | Kageyama | ..... | 84/610 |
| 6,166,313 | A * | 12/2000 | Miyamoto | ..... | 84/477 R |
| 7,667,126 | B2 | 2/2010 | Shi | | |
| 2003/0024375 | A1 * | 2/2003 | Sitrick | ..... | 84/477 R |
| 2004/0112203 | A1 * | 6/2004 | Ueki et al. | ..... | 84/613 |

* cited by examiner

*Primary Examiner* — Elvin G Enad
*Assistant Examiner* — Andrew R Millikin
(74) *Attorney, Agent, or Firm* — Klarquist Sparkman, LLP

(57) ABSTRACT

Melody and accompaniment audio signals are received and processed to identify one or more harmony notes and a harmony signal is produced based on the one or more harmony notes. Typically the melody note is identified and a spectrum of the accompaniment audio signal and is obtained, and one or more harmony notes are identified based on the melody note and the accompaniment spectrum. The melody, and accompaniment signals can be processed in real-time for combination with the harmony signal in an audio performance. In some examples, audio signals are processed and harmonies generated for subsequent performance based on, for example, MIDI files generated from the audio signals.

68 Claims, 14 Drawing Sheets

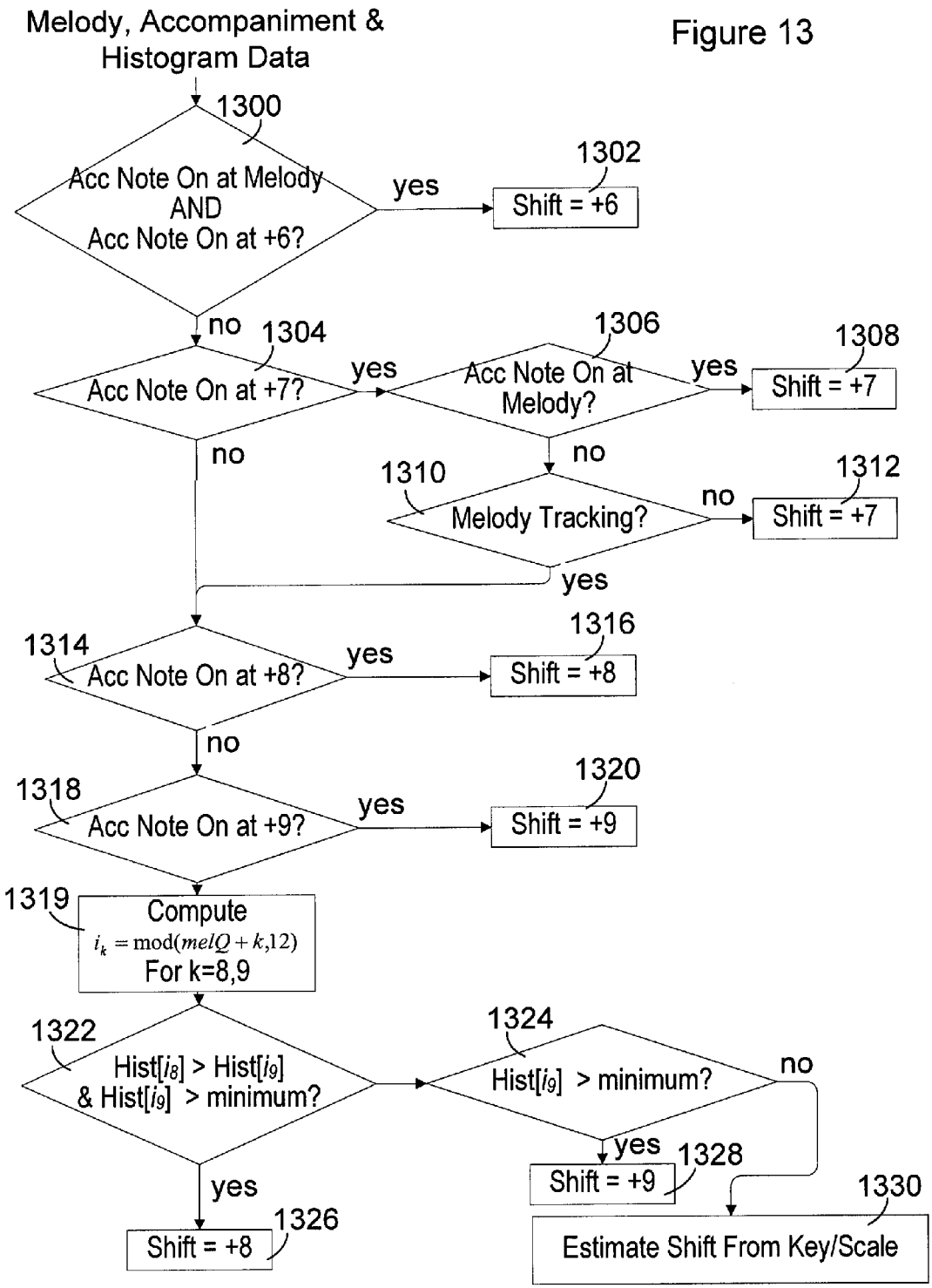
Melody, Accompaniment & Histogram Data
Figure 13
1300
Acc Note On at Melody AND Acc Note On at +6?
yes
1302
Shift = +6
no
1304
Acc Note On at +7?
yes
1306
Acc Note On at Melody?
yes
1308
Shift = +7
no
no
1310
Melody Tracking?
no
1312
Shift = +7
yes
1314
Acc Note On at +8?
yes
1316
Shift = +8
no
1318
Acc Note On at +9?
yes
1320
Shift = +9
1319
Compute
$i_k = \mathrm{mod}(melQ + k, 12)$
For k=8,9
1322
Hist[$i_8$] > Hist[$i_9$] & Hist[$i_9$] > minimum?
1324
Hist[$i_9$] > minimum?
no
yes
1328
Shift = +9
yes
1326
Shift = +8
1330
Estimate Shift From Key/Scale

MUSICAL HARMONY GENERATION FROM POLYPHONIC AUDIO SIGNALS

CROSS-REFERENCE TO RELATED APPLICATIONS

This application claims the benefit of U.S. Provisional Application 60/849,384, filed Oct. 2, 2006 and that is incorporated herein by reference.

TECHNICAL FIELD

The disclosure pertains to musical harmony generation.

BACKGROUND AND SUMMARY

A harmony processor is a device that is capable of creating one or more harmony signals that are pitch shifted versions of an input musical signal. Non-real-time harmony processors generally operate on pre-recorded audio signals that are typically file-based, and produce file-based output. Real-time harmony processors operate with fast processing with minimal look-ahead such that the output harmony voices are produced with a very short delay (less than 500 ms, and preferably less than 40 ms), making it practical for them to be used during a live performance. Typically, a real-time harmony processor will have either a microphone or instrument signal connected to the input, and will use a preset key, scale and scale-mode, or MIDI note information, to attempt to create musically correct harmonies. Some examples described in this disclosure are real-time harmony generators, although non-real-time harmony generators can also be provided.

There are a few real-time harmony processors currently available in the market. Although these products have been somewhat successful, there have always been three major complaints:

1. The harmonies generated from MIDI note information (generally referred to as chordal mode or vocoder mode) are unsatisfactory because they tend to change pitch much less frequently than the input melody signal. As a work-around, it is sometimes possible to enter each harmony note individually, or else create a custom chord to match each input melody note, but these are both difficult, tedious, and often require extra interaction from the performer in order to step through the notes. Also, because the changes in the harmony notes are not triggered by the melody notes themselves (instead either a foot switch or MIDI sequencer is commonly used), the harmonies can sound unnatural and out of step with the melody line.
2. When key and scale information is entered prior to starting a song, the harmonies can then be generated in step with the melody line (this is often called scalic mode). However, because the chord structure of a wide range of songs does not follow a set of rules that can be predetermined, the harmonies produced by this method often contain notes which are not musically correct because they are dissonant with respect to the accompaniment notes in situations where dissonance is unpleasant, thus limiting the usefulness of the harmony processing.
3. The existing products are very difficult to use because they require musical information such as key, scale, scale-mode, etc. to be entered before harmonies can be generated (for scalic mode), or else they require each harmony note or corresponding chord for each harmony note to be entered manually and then triggered throughout the performance.

In order to overcome these shortcomings harmony generation systems that create musically correct harmonies for a wide range of songs, and do so without requiring any extra skill from the user beyond singing and playing his/her instrument are disclosed. Such systems and methods generally are based on:

1. Real-time extraction of individual notes from an instrument signal that contains multiple accompaniment notes mixed together (e.g., a strummed guitar). Note that this is a very different problem from recognizing chords from MIDI data which is currently quite common in the prior art. MIDI data is electronically generated (for example from an electronic keyboard) and contains all the individual note information explicitly, and note extraction is unnecessary.
2. Real-time computation of musically correct harmonies (generally consonant or deliberately dissonant) using a new method of harmony note generation that is not simply based on either the current recognized chord or the currently entered scale and scale-mode information for the song. Instead, harmonies are generated using a dynamic algorithm that looks at the current performance over several time-scales (current accompaniment notes, localized scale mode based on melody and accompaniment note history, and long-term dynamically-derived key, scale, and scale-mode information). As a result, the harmonies created move much more actively than existing chordal harmony methods, and are musically correct with respect to the accompaniment notes.

Harmony Overview

Harmony occurs when two or more notes are sounded at the same time. It is well known (see, for example, Edward M Burns, "Intervals, Scales, and Tuning," *The Psychology of Music,* $2^{nd}$ ed., Diana Deutsch, ed., San Diego: Academic Press (1999) that harmonies can be either consonant or dissonant. Consonant harmonies are made up of notes that complement each others' harmonic frequencies, and dissonant harmonies are made up of notes that result in complex interactions (for example beating). Consonant harmonies are generally described as being made up of note intervals of 3, 4, 5, 7, 8, 9, and 12 semitones. Consonant harmonies are sometimes described as "pleasant", while dissonant harmonies are sometimes thought of as "unpleasant," though in fact this is a major simplification and there are times when dissonant harmonies can be musically desirable (for example to evoke a sense of "wanting to resolve" to a consonant harmony). In most forms of music, and in particular, western popular music, the vast majority of harmony notes are consonant, with dissonant harmonies being generated only under certain conditions where the dissonance serves a musical purpose.

In the following discussion, we describe in a general way how harmony notes should be generated in order to maximize the consonance with both the melody note and the accompaniment notes. It should be noted that this does not imply that dissonant harmonies should never be generated—it is only meant to illustrate how to achieve a harmony line that is musically correct in the sense that harmony notes are generally consonant, but only chosen to be dissonant when that is considered desirable.

When generating harmonies from a melody signal, there are clearly several note choices that will provide consonant harmonies. When an accompaniment signal is present, the choice of harmony note will be narrowed because some of the harmony notes may be dissonant with one or more notes in the accompaniment. If there are no notes actively being played that can distinguish between various choices of harmony notes, then the choice of harmony notes should be limited in such a way that the chosen harmony note is consonant with the most frequently heard notes over a longer time-scale, for example, the notes corresponding to the recent set of accompaniment notes, or the key of the song.

By way of example, assume that a song in the key of G major is being played, and at a given point in time, the melody note is A, and the accompaniment notes are A, C#, and E (A major). Three possible choices of harmony notes that are consonant with the melody are C (+3), C# (+4), and D (+5). If the accompaniment signal is not used (as is the case with the prior art), the most common choice for the harmony note would be C as it is a minor $3^{rd}$ interval from A and is also in the key of G. However, the choice of C would form a strongly dissonant interval with the accompaniment note C# (+1) while the choice of C# would be still be consonant with the A in the melody but would avoid the one semitone dissonance.

Disclosed herein are harmony generation systems such as vocal harmony generation systems (signal processing algorithms implemented in software and/or as hardware or a combination thereof) that take as input a vocal melody signal and a polyphonic accompaniment signal (e.g. a guitar signal), and output one or more vocal harmony signals that are musically correct in the context of the melody signal and underlying accompaniment signal. This allows, for example, a solo musician to include harmonies in his/her performance without having an actual backup singer. The examples describe a system that makes it possible for a performer to create musically correct harmonies by simply plugging in his microphone and guitar, and, without entering any musical information into the harmony processor, singing and playing the accompaniment in exactly the manner to which he is accustomed. In this way, for the first time, harmony processing can be accomplished in an entirely intuitive way.

The systems described herein generally include a polyphonic note detection component and a harmony generation component. Polyphonic pitch detection typically involves algorithms that can extract the fundamental frequency (pitch) of several different sounds that are mixed together in a single audio signal. In some examples, systems and methods are described that can extract such pitches in processing time of less than about 500 ms, 250 ms, 150 ms, or 40 ms. Such processing is generally referred to herein as real-time.

In some examples, apparatus are disclosed that comprise a signal input configured to receive a digital melody signal and a digital accompaniment signal. An accompaniment analyzer is configured to identify a spectral content of the digital accompaniment signal and a pitch detector is configured to identify a current melody note based on the digital melody signal. A harmony generator is configured to determine at least one harmony note based on the current melody note and the spectral content of the digital accompaniment signal. In some examples, an analog-to-digital converter is configured to produce at least one of the digital melody signal and the digital accompaniment signal based on a corresponding analog melody signal or analog accompaniment signal, respectively. In additional examples, an open strum detector is configured to detect an open strum of a multi-stringed musical instrument based on the digital accompaniment signal and coupled to the harmony generator so as to suppress a determination of a harmony note based on the open strum. In other examples, the accompaniment analyzer is configured to identify at least one note contained in the digital accompaniment signal. In still further representative examples, the harmony note generator is configured to select the at least one harmony note so as to be consonant with the current melody note and the digital accompaniment signal. In some embodiments, the harmony generator produces a MIDI representation of the at least one harmony note and an output is configured to provide an identification of the at least one harmony note. In other examples, a mixer is configured to receive at least one of a melody signal or an accompaniment signal based on the digital melody signal and the digital accompaniment signal, respectively, and a harmony signal based on the at least one harmony note, and produce a polyphonic output signal.

In further examples, musical accompaniment apparatus further include an output configured to provide an identification of the at least one harmony note. In other examples, the harmony note generator produces the harmony note by pitch shifting the current melody signal. In some cases the harmony note is produced substantially in real-time with receipt of the accompaniment signal. In alternative examples, the harmony note generator includes a synthesizer configured to generate the harmony note. In some cases the harmony note is generated substantially in real-time with receipt of the accompaniment signal. In representative examples, the harmony generator is configured to produce the harmony note substantially in real-time with the current melody note, and the digital melody signal is based on a voice signal and the digital accompaniment signal is based on a guitar signal.

Representative methods include receiving an audio signal associated with a melody and an audio signal associated with an accompaniment and estimating a spectral content of the audio signal associated with the accompaniment audio signal. A current melody note is identified based on the audio signal associated with the melody, and a harmony note is determined based on the spectral content and the current melody note. In some examples, an audio signal associated with the harmony note is mixed with at least one of the melody and accompaniment audio signals to form a polyphonic output signal and can be produced substantially in real-time with receipt of the current melody note. In other examples, the harmony note is produced substantially in real-time with the current melody note. In some examples, an audio performance is based on the polyphonic output signal. In some examples, computer-readable media contain computer executable instructions for such methods.

In other representative methods, a plurality of notes played on a multi-stringed instrument is received, and the received notes are evaluated to determine if the notes are associated with an open strum of the multi-stringed instrument. In some examples, if an open strum is detected, the received notes are replaced with a substitute set of notes. In some examples, the received notes are obtained from a MIDI input stream or are based on an input audio signal and the substitute set of notes is associated with the received notes so as to produce an output audio signal. In additional embodiments, the open strum is detected by comparing the received notes with at least one set of template notes. In some embodiments, the at least one set of template notes is based on an open string tuning of the multi-stringed musical instrument. In further examples, the open strum is detected by measuring at least one interval between adjacent notes in the received notes, and comparing the at least one interval to intervals associated with at least one note template. In still further examples, the open strum is detected by normalizing the notes to an octave range and comparing the normalized notes to at least one set of template notes. According to some examples, notes associated with a detected open strum are replaced with a previously detected set of notes that is not associated with an open strum. In some examples, the replacement notes are associated with a null set of notes.

According to representative examples, apparatus comprise an audio processor configured to determine a plurality of notes in an input audio signal, and an open strum detector configured to associate the input audio signal with an open strum based on the plurality of notes. In some examples, a memory is configured to store at least one set of notes corresponding to an open strum, wherein the open strum detector is in communication with the memory and associates the input audio signal with the open strum based on the plurality of notes and the at least one set of notes. In further examples, an audio source is configured to provide at least one note if an open strum is detected. In other examples, an indication is provided that is associated with detection of any open strum. The indication can be provided as an electrical signal for coupling to additional apparatus, as a visual or audible indication, or otherwise provided, and can be provided substantially in real-time.

Note detection methods comprise determining a note measurability index as a function of time and adapting a placement and/or duration of a temporal window in order to maximize or substantially increase the note measurability index. An adapted spectrum based on the windowed signal is determined, and at least one note having harmonics corresponding to the adapted spectrum is identified. In some examples, the position or duration of the spectral window is adapted based on a difference between the input audio signal spectrum and a magnitude of a spectral envelope of the input audio signal at frequencies associated with the plurality of notes. In additional examples, a spectral quality value is assigned based on an average of a difference between the input audio signal spectrum and the magnitude of the spectral envelope of the input audio signal, wherein the window duration is adapted so as to achieve the assigned spectral quality. In further representative examples, the at least one note is selected so that harmonics of the at least one note correspond to spectral peaks in the adapted spectrum. In other examples, the spectrum of the input audio signal is obtained based on outputs of a plurality of bandpass filter outputs at frequencies corresponding to the predetermined notes. In further examples, the window is adapted to obtain a predetermined value of spectral quality.

Musical accompaniment apparatus comprise a signal input configured to receive a digital melody signal and a digital accompaniment signal, an accompaniment analyzer configured to identify a spectral content of the digital accompaniment signal, and a pitch detector configured to identify a current melody note based on the digital melody signal.

In additional methods, a note measurability index of an input audio signal as a function of time is produced, and a temporal window is adjusted based on the determined note measurability index. A spectrum of the input audio signal based on the adjusted temporal window is obtained, and at least one note having harmonics corresponding to the determined spectrum is identified. In some examples, a temporal placement or a duration of the temporal window is adapted based on the determined note measurability index. In additional examples, the note measurability index is based on a difference between a spectrum of the input audio signal and a magnitude of a spectral envelope of the input audio signal. In additional embodiments, a note measurability index is assigned based on an average of the difference between the input audio signal spectrum and the magnitude of the spectral envelope of the input audio signal These and other features and aspects of the disclosed technology are set forth below with reference to the accompanying drawings.

BRIEF DESCRIPTION OF THE DRAWINGS

FIG. 13 is a block diagram illustrating a harmony subsystem that is configured to produce a harmony note that is nominally 7 semitones from a melody note, but can vary between 6 semitones and 9 semitones in order to create a musically correct harmony sound.

DETAILED DESCRIPTION

Figure 1:
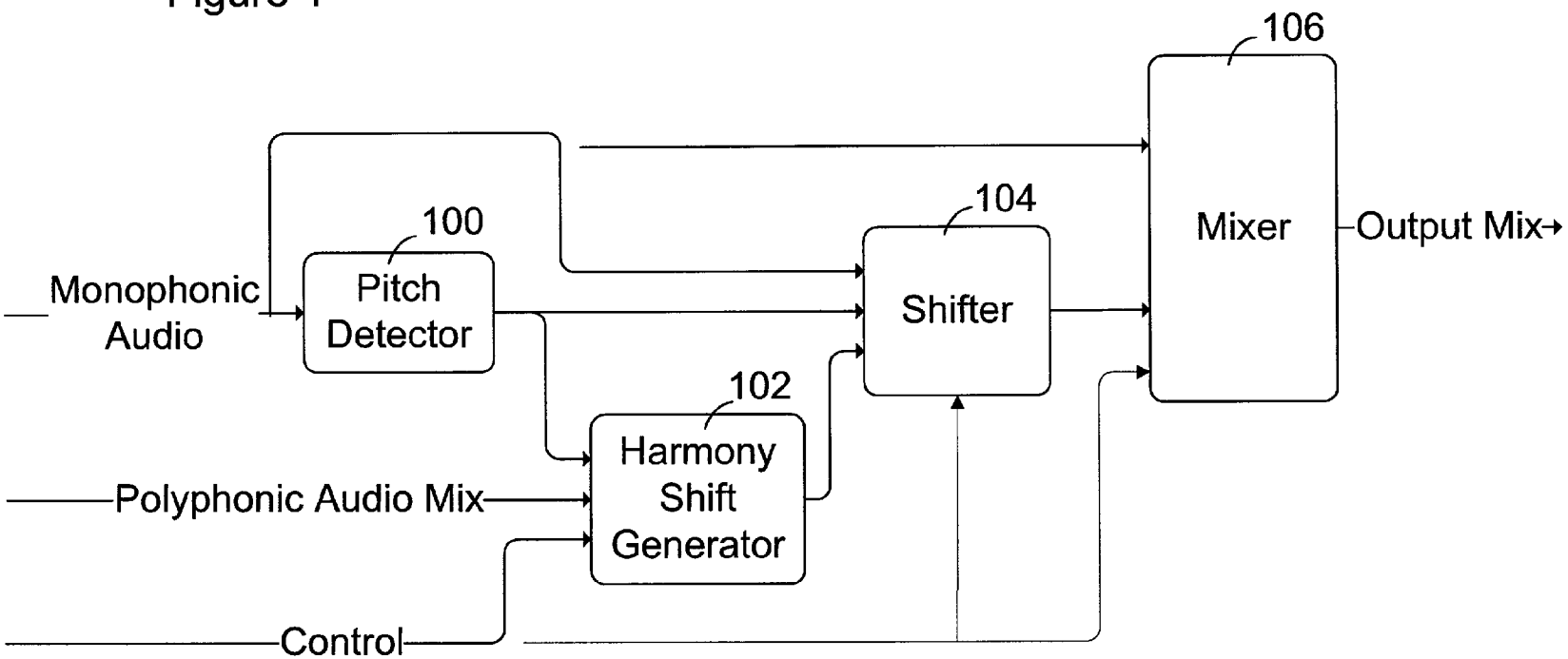
FIG. 1 is a block diagram of a representative vocal harmony generation system.

The described systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

One example disclosed is a vocal harmony generation system that takes as input a vocal melody signal and a polyphonic accompaniment signal (e.g., a guitar signal), and outputs one or more vocal harmony signals that are musically correct in the context of the melody signal and underlying accompaniment signal.

Although some examples use a vocal signal for the input melody, it should be noted that any monophonic (single pitch) input signal could be used. Furthermore, although this example uses a guitar signal as the polyphonic accompaniment signal, it should be noted that any polyphonic instrument or group of instruments could be used for this purpose. It should also be noted that MIDI note data may be used instead of a polyphonic audio signal to generate the harmonies.

Some disclosed examples:

1. Create one or more musically correct harmony notes from a melody note and a polyphonic accompaniment signal, wherein "musically correct" refers to the fact that note detection in the polyphonic signal is used to avoid unwanted dissonance between the harmony notes and the accompaniment (or to produce a selected dissonance).
2. Create musically correct harmony notes based on information extracted from the current and past accompaniment and melody note data.
3. Generate harmonies with "melody note tracking" in order to make the harmonies follow the input melody.
4. Include a guitar signal note detection system that identifies and ignores unintentional strum patterns (e.g. open strums, low energy strums, low quality strums)
5. Include a guitar signal note detection system that estimates missing notes by using past input data for the following situations:
   "power chords (only root and $5^{th}$ played)
   "missing 5ths"
   "missing 7ths"

As used herein, a signal or audio signal generally refers to a time-varying electrical signal (voltage or current) corresponding to a sound to be presented to one or more listeners. Such signals are generally produced with one or more audio transducers such as microphones, guitar pickups, or other devices. These signals can be processed by, for example, amplification or filtering or other techniques prior to delivery to audio output devices such as speakers or headphones. For convenience, sounds produced based on such signals are referred to herein as audio performance signals or simply as audio performances.

Figure 14:
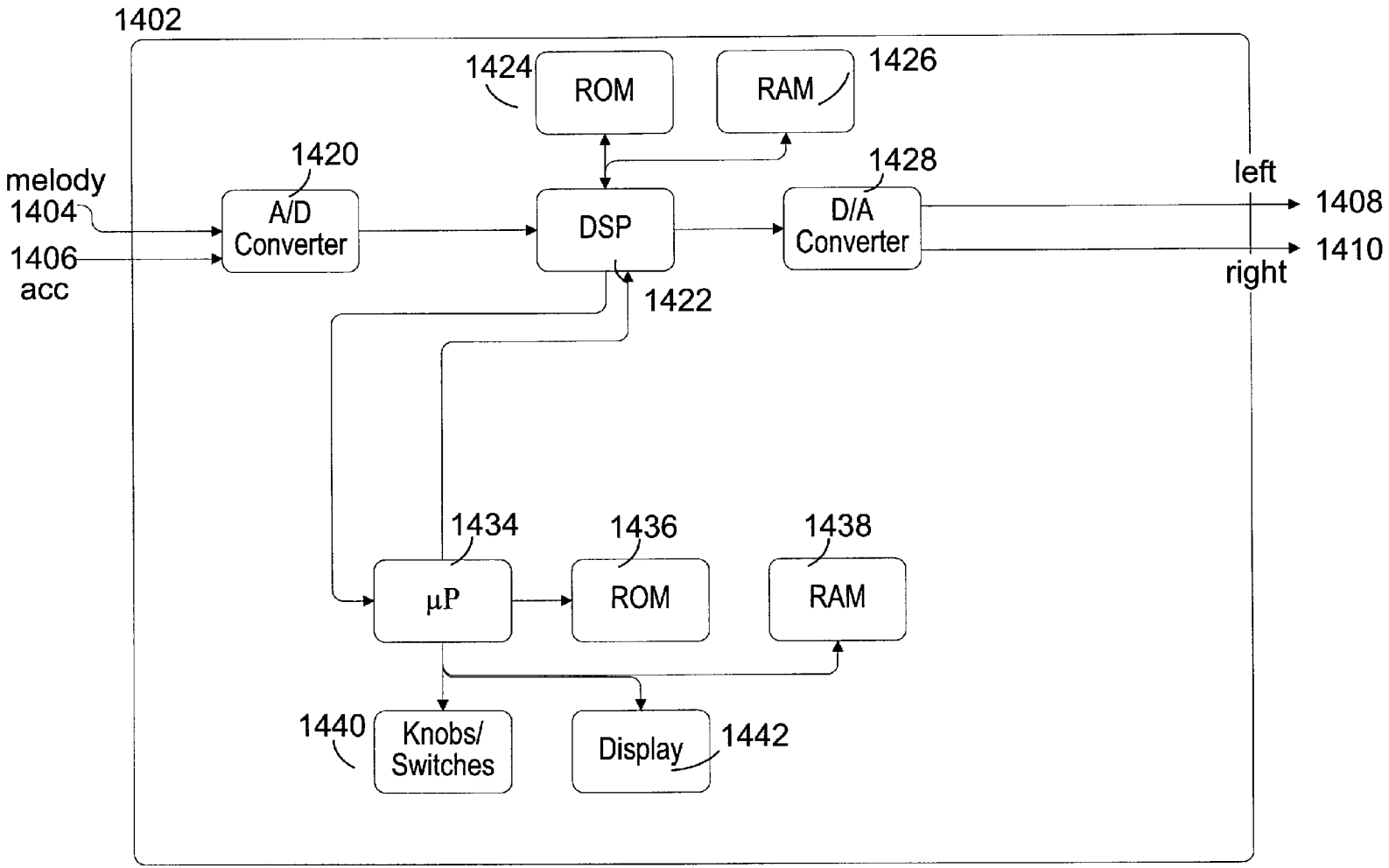
FIG. 14 is a block diagram of a representative harmony generation system based on a digital signal processor.

FIG. 14 is a block diagram of a representative vocal harmony generation system (1402) that receives two input signals a monophonic melody signal (1404) and a polyphonic accompaniment signal (1406). The system (1402) generates left and right components (1408, 1410), respectively, of a stereo output signal containing a mix of the original melody signal and one or more generated harmony signals that are pitch shifted versions of the melody signal where the pitch shift intervals are musically correct within the context of the accompaniment signal.

The input melody and accompaniment signals are typically analog audio signals that are directed to an analog to digital conversion block (1420). In some embodiments, the input signals may already be in digital format and thus this step may be bypassed. The digital signals are then sent to a digital signal processor (DSP) (1422) that stores the signals in random access memory (1426). Read-only memory (ROM) (1424) containing data and programming instructions is also connected to the DSP. The DSP (1422) generates a stereo signal that is a mix of the melody signal and various harmony signals as detailed in the disclosure below. These signals are converted to analog (if necessary) using a digital-to-analog converter (D/A) (1428) and sent to an output. A microprocessor is connected to ROM (1436) and RAM (1426) that contain program instructions and data. It is also connected to the user interface components such as displays, knobs, and switches (1440), (1442), and further connected to the DSP (1422) in order to allow the user to interact with the harmony generation system. Other user input devices such as mice, trackballs, or other pointing devices can be included.

FIG. 1 is a block diagram of a harmony generation system as implemented in a digital signal processor. First, the monophonic audio signal representing the melody (e.g., a human voice signal) is passed into a pitch detector (100). This block examines the periodicity in the audio signal and determines a voicing indicator which is set to be TRUE when periodicity is detected in the signal. In the case of voiced signals, the value of the fundamental frequency is also determined. A harmony shift generator (102) takes as input this pitch and voicing information, as well as the musical accompaniment signal which may be polyphonic (e.g., a strummed guitar signal). Control information, such as, for example, harmony styles received a user interface can also be received. The harmony shift generator (102) analyzes the polyphonic accompaniment signal in context with the melody pitch information to determine a pitch shift amount relative to the input melody signal that will create a musically correct harmony signal. This pitch shift amount is passed into a pitch shifter (104) which also takes as input the monophonic melody signal and pitch/voicing information. The shifter (104) modifies this signal by altering the fundamental pitch period by the shift amount calculated in the block (102) and produces a pitch-shifted output signal. This output signal is then mixed with the input melody signal by a mixer (106) in order to create a vocal harmony signal. The mixer (106) can be a standard audio mixer that mixes and pans the melody and harmony signals according to the control information. It will be appreciated by one skilled in the art that the processing described above can be applied to multiple harmony styles in order to create a signal having a lead melody and multiple harmony voices.

In the following detailed description of this representative system, we will refer to the term "note number." The note number is an integer that corresponds to a musical note. In our system, note 60 corresponds to the note known as "middle C" on a piano. For each semitone up or down from middle C, the corresponding note number increases or decreases by one. So, for example, the note C# that is one octave and one semitone higher than middle C is assigned the note number 73.

When signal frequencies are converted to note numbers, we use the equal-tempered convention which uses the following formula:

$$n=69-12\log_2(f_{ref}/f) \quad (1)$$

wherein n is a note number, and f is an input frequency in hertz (f>27.5 Hz), and $f_{ref}$ is a reference frequency of note 69 (A above middle C), for example, 440 Hz. Note that using this equation allows us to extend the concept of note number to include non-integer values. The meaning of this is straightforward. For example, a note number of 55.5 means that the input pitch corresponds to a note which is half way between G and G# on the logarithmic note number scale.

It will be obvious to those skilled in the art that for some embodiments it may be better to use another system for converting frequencies to musical notes, for example, the true-tempered musical system can be used.

Another term used in this disclosure is the term "normalized note numbers." This refers to a set of note numbers ranging from 0 to 11, defined as follows:

TABLE 1

Normalized Note Numbers

| Note Number | Musical Note |
|---|---|
| 0 | C |
| 1 | C# or Db |
| 2 | D |
| 3 | D# or Eb |
| 4 | E |
| 5 | F |
| 6 | F# or Gb |
| 7 | G |
| 8 | G# or Ab |
| 9 | A |
| 10 | A# or Bb |
| 11 | B |

Note numbers can be mapped into normalized note numbers by converting first from note number to musical note, and then from musical note to normalized note number according to the table above, where the specific octave in which the note occurred is ignored.

Another term used in this disclosure is "frame." This is a fixed number of contiguous samples of audio (which can be either the melody or the accompaniment).

Pitch Detector

The pitch detector (100) is responsible for classifying the input monophonic melody signal as either "voiced," when the signal is nominally periodic in nature, or "unvoiced" when the signal has no discernable pitch information (for example during sibilant sounds for a vocal melody signal). There are very many pitch detection methods that are suitable for this application (see, for example, W. Hess, "Pitch and voicing determination", in *Advances in Speech Signal. Processing*, Sondhi and Furui, eds., Marcel Dekker, New York (1992). In one example system, the algorithm specified in U.S. Pat. No. 5,301,259 (further enhanced from U.S. Pat. No. 4,688,464) is used. However any pitch detection method capable of detection of the fundamental frequency in a monophonic source with low delay (typically less than about 40 ms) is suitable.

Harmony Shift Generator

Figure 2:
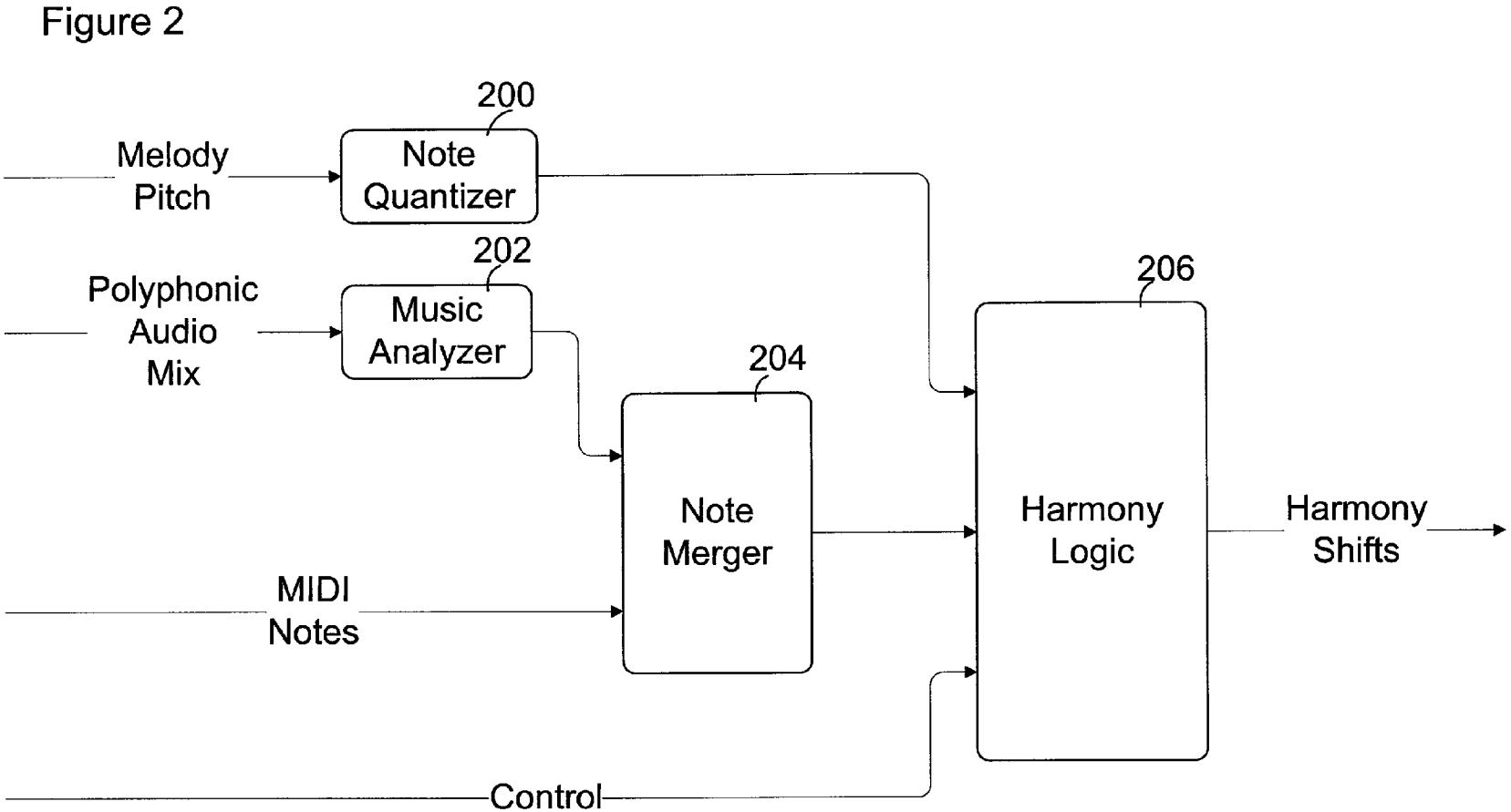
FIG. 2 is a block diagram of a representative harmony shift generator.

The harmony shift generator (102) is shown in further detail in FIG. 2. Melody pitch data from the pitch detector (100) is directed to a note quantizer (200) which is described in detail below. The polyphonic audio mix signal containing the musical accompaniment is sent to a music analyzer (202) in order to extract note information. This block is described in detail below. When input MIDI notes are present, this data is passed through a note merger block (204) which combines note information from the polyphonic accompaniment with the MIDI note information. Note that MIDI information is not required for the system to work, and is only described here because it can be used in addition to the polyphonic accompaniment signal, or instead of the polyphonic accompaniment signal. Finally, a harmony logic block (206) takes the quantized melody pitch, the accompaniment note information, and control information such as harmony voicings and styles, and creates one or more harmony shifts. The harmony logic block (206) is described in detail below as well.

Melody Note Quantizer

The melody note quantizer (200) converts the pitch of the melody into a fixed note number, and determines whether or not that note has become stable. This is necessary because many types of monophonic input melody signals will be from sources that do not produce notes with frequencies corresponding to exact note numbers on a musical scale, as, for example, is the case with the human singing voice. Furthermore, the system can make better harmony decisions if it determines whether the input note at the current time has been stable over a period of time, or is of a rapidly changing nature such as when a singer "scoops" into a note.

Figure 10:
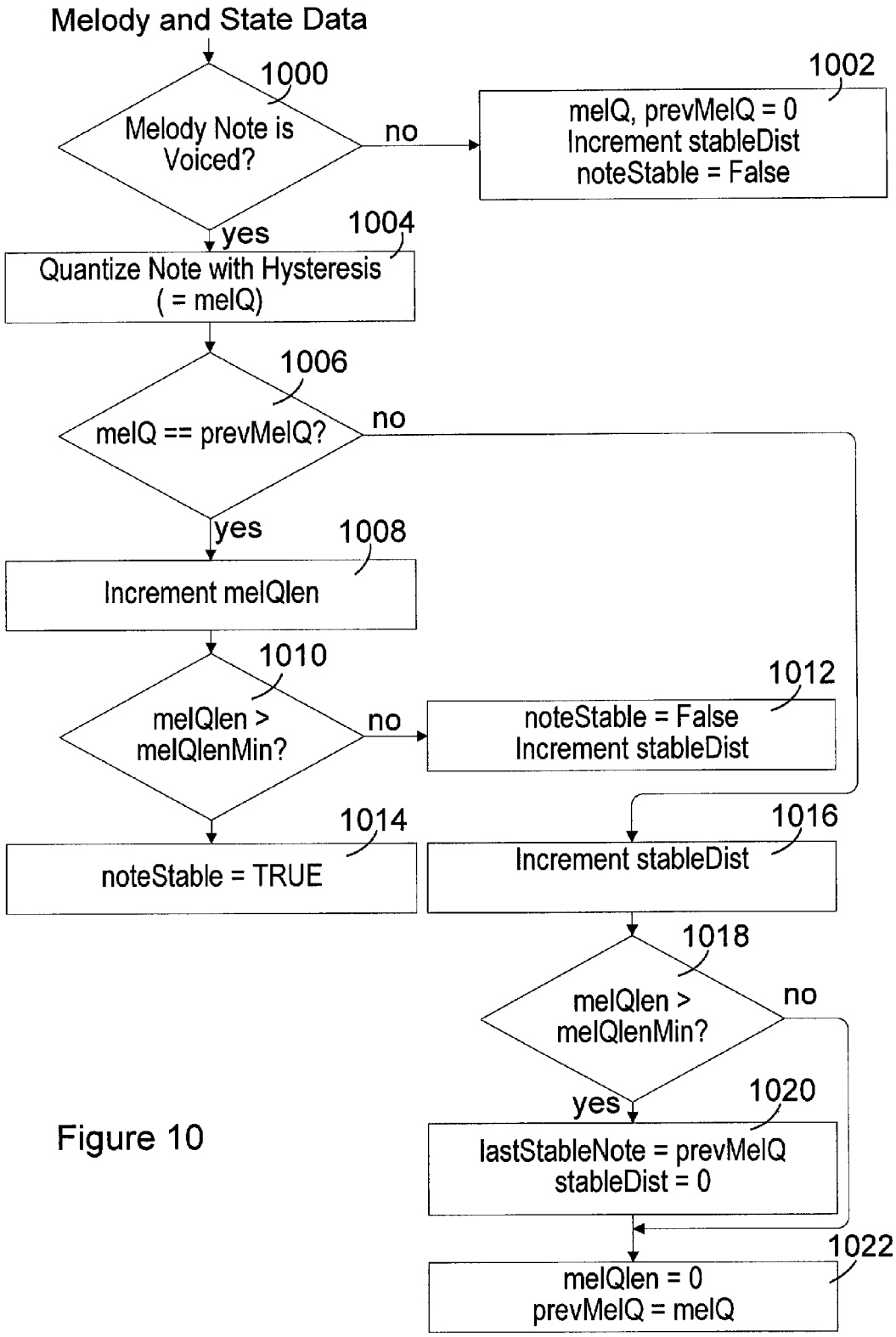
FIG. 10 is a block diagram of a representative melody note quantizer.

FIG. 10 shows a flowchart of signal processing for melody note quantization. The inputs to the processing are the melody note, which is expressed as a real note number based on the detected input frequency according to equation 1, and a voicing indicator which is either "voiced" when a monophonic pitch is detected, or "unvoiced" otherwise (for example when the input is from a sibilant vocal sound). State data is maintained between calls to the note quantization sub-system and consists of the following:

- prevMelQ: the quantized melody note from a previous frame
- lastStableNote: the value of the most recent stable note prior to the currently tracked note
- stableDist: the distance (in frames) between the last stable note and the current note
- melQlen: the length of the currently tracked note (in frames)

Referring to FIG. 10, the processing starts by checking the voicing state of the input note in a step (1000). If the input melody is unvoiced, melQ and prevMelQ are set to 0, stableDist is incremented, and noteStable is set to FALSE. Otherwise (i.e., the input note is voiced) processing proceeds to a step (1004) in which the input note is quantized to an integer note so that it can be associated with a musical note. In this system, rather than merely rounding off the real note number in order to obtain the nearest note, we use hysteresis to adjust the thresholds in a way that if a previous note is chosen, it may be preferred over a note that might be closer. Specifically, the threshold for crossing from one note to the next is moved by, for example, 0.2 semitones further from the previously chosen note. This will prevent the resulting quantized note from jumping between two adjacent notes when the input note is roughly half way between two musical notes.

Once a quantized note melQ, is obtained, processing proceeds to step (1006) wherein the previous quantized melody melQ is compared to the current quantized melody melQ. If they are the same, the length of the current note (melQlen) is incremented in step (1008). At this point, the current note is checked to determine if it is long enough to be considered stable. In one system, we use a value of 17 frames which corresponds to a minimum note length of approximately 100 ms. If the current note is checked to determine if it is long enough, we set the noteStable flag to TRUE in a step (1014). Otherwise, the noteStable flag is set to FALSE, and a distance (time) from the last stable note to current stable note (stableDist) is incremented in a stop (1012).

If, at step (1006), the previous note and current notes are not equal (i.e. the input melody note has changed), in a step (1016) stableDist is incremented. In a step (1018) the last note (which has now completed) is evaluated to determine if it was long enough to become a new current stable note by seeing if it is greater than melQlenMin which is set to 17 frames (~100 ms) in one example system. If so, a state variable lastStableNote is changed to prevMelQ and the new stableDist to is set to zero (1020). Otherwise, this step is skipped and melQlen is set to zero (1022) (as we are starting a new note) and prevMelQ is assigned the value in a step (1022).

Music Analyzer

Figure 3:
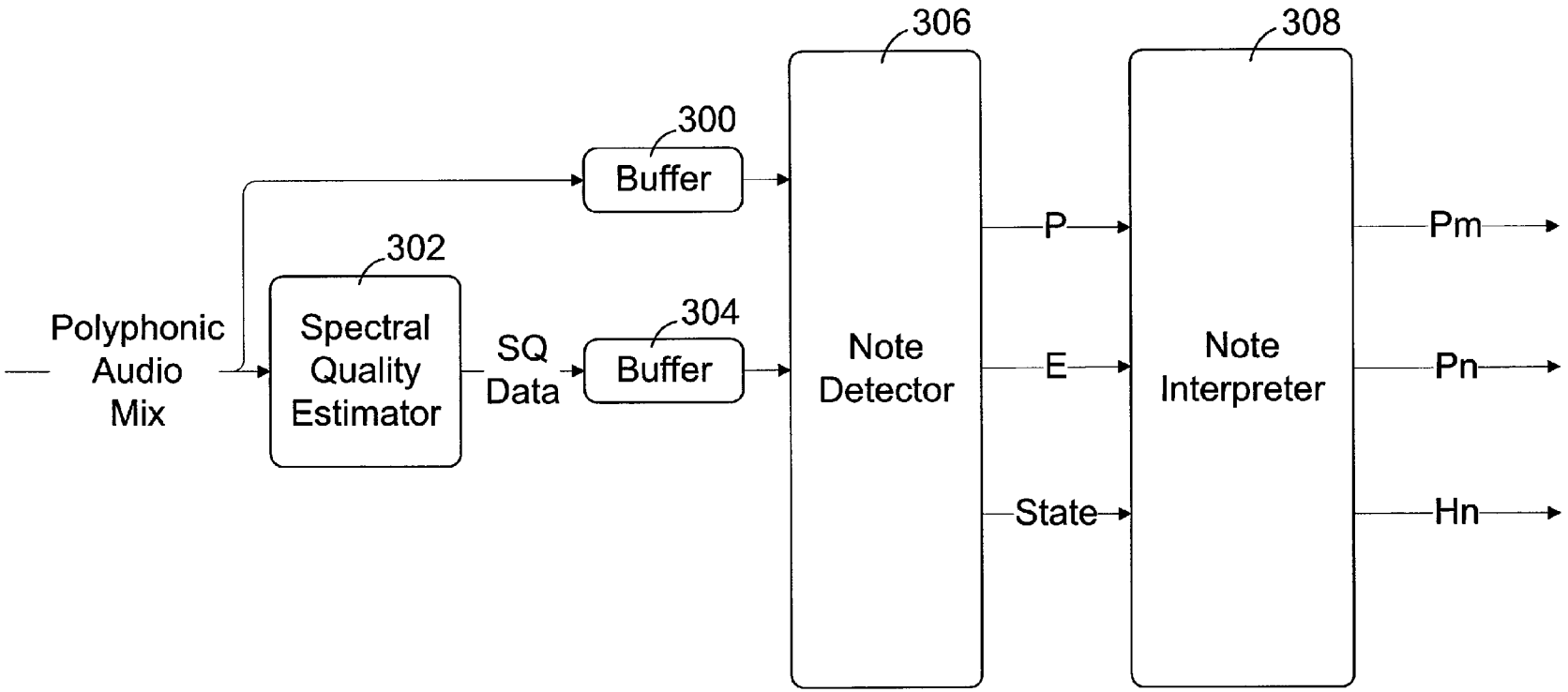
FIG. 3 is a block diagram of a music analyzer that is coupled to receive a polyphonic audio mix.

The music analyzer, as shown in FIG. 3, uses a polyphonic audio mix, such as a guitar signal, or a full song mix, as an input and produces Pm—a length 128 vector of note probabilities for note numbers 0-127

Pn—a length 12 vector of normalized note probabilities

Hn—a length 12 vector of normalized note histogram values

In the present embodiment, the polyphonic audio mix consists of a 44100 Hz signal downsampled by 16 to obtain a sampling frequency of 2756.25 Hz. The audio is buffered up in block 300 into 1024 length buffers, which are stepped at 64 sample (23.2 ms) intervals. Clearly the sampling frequency, buffer size and step interval are not critical, but these values were found to work well.

The Spectral Quality Estimator block (302) analyzes the polyphonic audio, to produce spectral quality (SQ) data which is then buffered up in block 304. The SQ Data is computed at a rate 16 times slower than the audio rate so a buffer size of 64 for the SQ Data covers the same time span (371.5 ms) as the audio buffer. A step size of 4 SQ Data samples (23.2 ms) was chosen to match the step size of the audio buffer. Once again, the exact rate and buffer size is not critical.

The note detector (306) takes in the audio buffer and the SQ Data buffer and produces P—a length 128 vector giving an initial guess at the note probabilities for note numbers 0-127.

E—a length 128 vector giving the energy in dB for each note for note numbers 0-127.

State—a scalar integer giving the note detection state

The note interpreter (308) takes in P(k), E(k) and state and produces Pm(k), Pn(k), Hn(k), and Hn Age, as described above.

Spectral Quality Estimator

Figure 4:
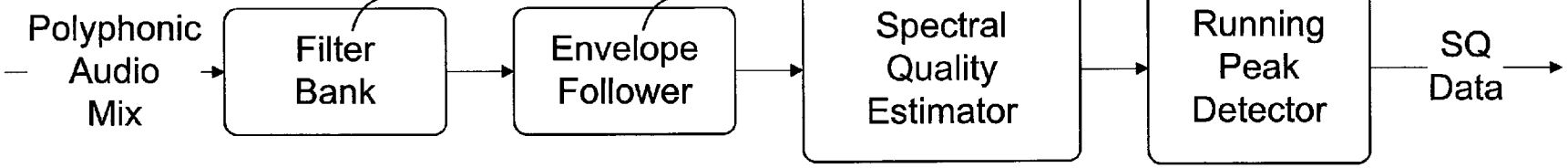
FIG. 4 is a block diagram of a Spectral Quality Estimator that is configured to receive a polyphonic audio mix and produce Spectral Quality (SQ) Data.

As shown in FIG. 4, the spectral quality estimator takes in a polyphonic audio mix and produces spectral quality (SQ) Data, consisting of SQ—a scalar giving the spectral quality value PkVal—the SQ value of the last peak found PkDir—the direction (+1,−1) of the last peak found PkDelay—the delay in samples of the last peak found The filter bank (400) consists of a constant Q digital filter bank with passbands centered on the expected location of specific notes. In the present embodiment, notes D3 to E5 (note numbers 50 to 76) were used to define centers for the filters, 0.5 semi-tones was used as the bandwidth of each filter, and $6^{th}$ order Butterworth designs were used for each filter, which works well for guitar inputs. Depending on the expected instrument or instruments contributing to the polyphonic mix, these parameters can be changed.

The envelope follower (402) analyzes each output channel from the filter bank block to estimate the envelope or peak level of the signal. The present embodiment takes advantage of the fact that the minimum frequency in each band is known. This allows us to compute the maximum wavelength to expect in the signal (i.e. 1/minimum frequency). A maximum value in a buffer 1.5 times the maximum wavelength was used as our envelope estimate. There are many types of envelope followers described in prior art that would provide sufficiently good results for the present invention.

The spectral quality estimator block (404) analyzes the filter bank envelopes xlin(k) and produces a spectral quality (SQ) estimate. The filter bank envelope values converted from linear values to dB values $$x(k)=20\log 10(xlin(k)) \tag{2}$$

A rough spectral envelope is computed by using the max of the current value and the closest 2 neighbors on either side $$xEnv(k)=\max(x(k-2:k+2)) \tag{3}$$

The average difference between the filter bank envelope vector and the spectral envelope is then computed $$y=\frac{\sum_{k=0}^{N-1}(xEnv(k)-x(k))}{N} \tag{4}$$

wherein N is a number of channels used in the filter bank.

A linear interpolation lookup table is used to transform this value to a spectral quality value between 0 and 1, where the break points in the lookup table are defined as follows

TABLE 2

| LUT Breakpoints | |
|---|---|
| Input (y) | Output (SQ) |
| 0 | 0 |
| 7.5 | 0.2 |
| 15 | 0.8 |
| 25 | 1 |

The running peak detector (406) is used to find the peaks in the SQ signal. This block uses the peak detector algorithm with a threshold T=0.2, which is shown in flowchart form in FIG. 7, with the exception that there is no stop condition (i.e. Knum=infinity). When a peak is found a the value of the peak, PkVal, is set to the SQ value of the peak, the direction of the peak, PkDir, is set to 1 if it is a positive peak, and −1 if it is a negative peak, and the delay of the peak, PkDelay, is set to 0. If a peak is not found in the current frame, then PkVal and PkDir remain unchanged from the last frame and PkDelay is increased by 1. It should be clear that the exact values of the parameters used in the present embodiment are not critical, but work well for a single guitar.

Although a specific type of spectral quality determination is described above, other methods and parameters can be used to determine if a received accompaniment, melody, or other audio input has spectral features suitable for identification of one or more notes. Such methods permit notes to be based on peaks that are sufficiently established so as to avoid production of notes based on background spectral features or noise. Methods for identification of suitable temporal regions to compute spectra can be based on determinations of a note measurability index that is associated with an extent to which one or more harmonics of a note are distinguishable from background noise. As used herein, a measurable note is a note for which at least one harmonic or the fundamental frequency is associated with a spectral power or spectral power density that is at least about 10%, 20%, 50%, or 100% greater that background spectral power at a nearby frequency. A note measurability index can be based on a difference in note harmonic (or note fundamental) spectral power with respect to background spectral power as well as a number of harmonics associated with measurable notes.

Note Detector

Figure 5:
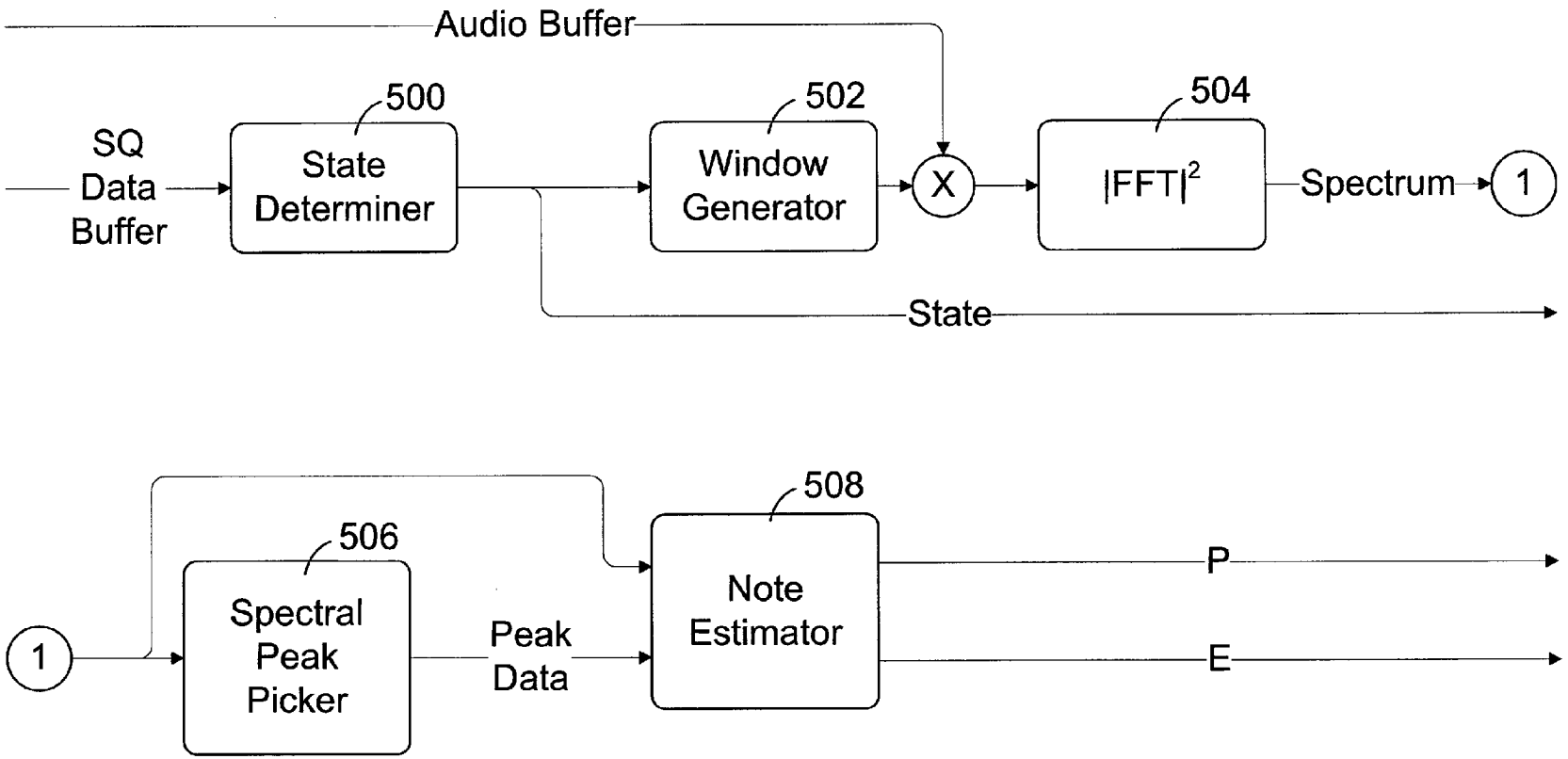
FIG. 5 is a block diagram of a note detector that is coupled to an audio buffer.

The note detector block, as shown in FIG. 5 takes in the audio buffer, and the SQ data buffer and produces P—a length 128 vector giving the probability that a note is on for note numbers 0-127.

E—a length 128 vector giving the energy in dB of each note for note numbers 0-127.

State—an integer scalar specifying the note detection state, as described below.

The state determiner (500) takes in the SQ data buffer, and produces an integer state value and an integer window length. The goal of this block is to produce as large a window as possible to increase the spectral resolution, while not contaminating the spectral estimate with audio data that has poor spectral quality. In a guitar signal, the spectral quality is generally quite poor at the moment when the strings are strummed, and the spectral quality improves as the strings ring out. In order to keep the latency as short as possible, a small window should be placed right after the strum instance. The spectral resolution will be poor due to the small window size, but since the noise of the initial part of the strum is avoided, the resulting spectrum and note estimates can be quite good. As the strings ring out, the window size should increase as well in order to increase the spectral resolution and resulting note estimation accuracy. To keep latency to a minimum, the window should always start at the front of the buffer, so the only thing that needs to be specified is the length of the window.

While the window size could vary continuously, a more computationally efficient system can be achieved by defining 8 states labeled 0 though 7. State 0 corresponds to a hold state, which implies that the notes should be held from the last frame rather than estimated in the current frame. This condition arises when the spectral quality is decreasing. State 1 through 7 correspond to window sizes that increase monotonically, and the determination of what state to use is governed by the delay of the last negative SQ peak and the drop in SQ value from the last positive peak. If the last peak was negative, then the state with largest window with a delay threshold less than the delay of the last negative peak is used. If the last negative peak has a delay less than the delay threshold for state 1, then the state is set to one. Also, if the last SQ peak is positive and the SQ value has dropped from this peak by more than 0.2, then the state is state to 0. The window sizes and delay thresholds for the current system are given in Table 3.

TABLE 3

Window sizes and delay thresholds for the different states.

| State | Window Size (samples) | Delay Threshold (samples) |
|---|---|---|
| 1 | 300 | 250 |
| 2 | 325 | 275 |
| 3 | 350 | 300 |
| 4 | 400 | 350 |
| 5 | 512 | 450 |
| 6 | 700 | 650 |
| 7 | 1024 | 1024 |

The window generator (502) uses the window length N defined by the state determiner (500) to produce a Blackman window of the specified size, where a Blackman window is defined as $$w(n) = 0.42 - 0.5\ \cos\left(2\pi\frac{n}{N}\right) + 0.08\ \cos\left(4\pi\frac{n}{N}\right),\ 0 \le n < N \tag{5}$$

This window is positioned at the front (i.e. side corresponding to the newest audio samples) of a 1024 point vector with the remaining elements set to 0, which is subsequently multiplied by the input audio buffer. The Fast Fourier Transform (FFT) is applied and the magnitude squared of each bin is computed in an FFT block 504 to produce a spectrum. Due to the fact that the resulting spectrum is symmetrical, only the first 512 bins of the spectrum are retained.

The spectral peak picker (506) then finds the important peaks in the spectrum. The resulting peak data is then processed by the note estimator (508) to produce estimates of the note probabilities P(k) and note energies E(k).

While FIG. 4 illustrates computation of a magnitude of an audio signal spectrum based on a Fast Fourier Transform (FFT), spectra can be estimated using other methods such as analysis by synthesis methods or non-linear methods.

Spectral Peak Picker

Figure 6:
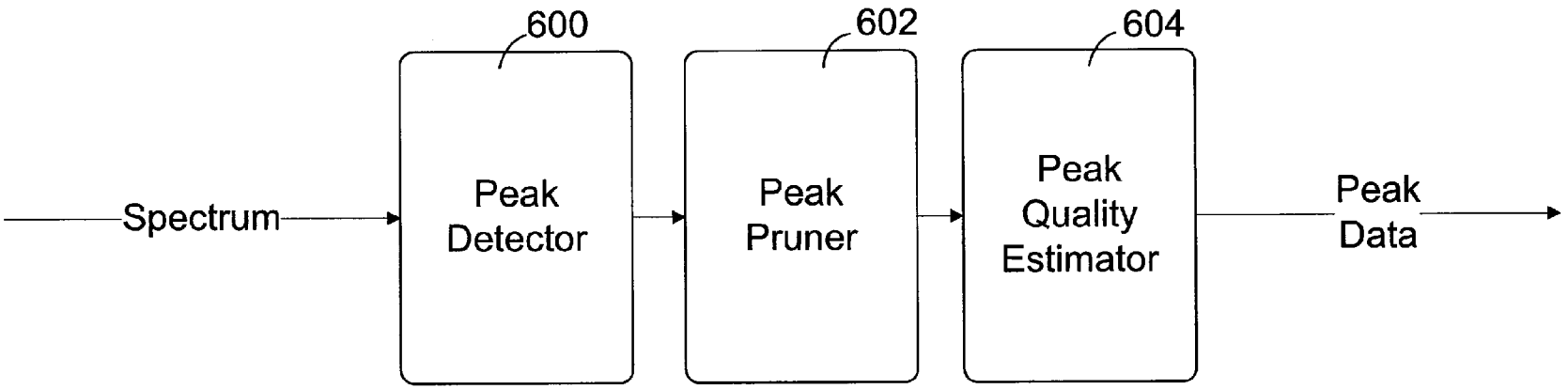
FIG. 6 is a block diagram of a representative spectral peak picker that is configured to receive a dB spectrum and produce peak data.
Figure 7:
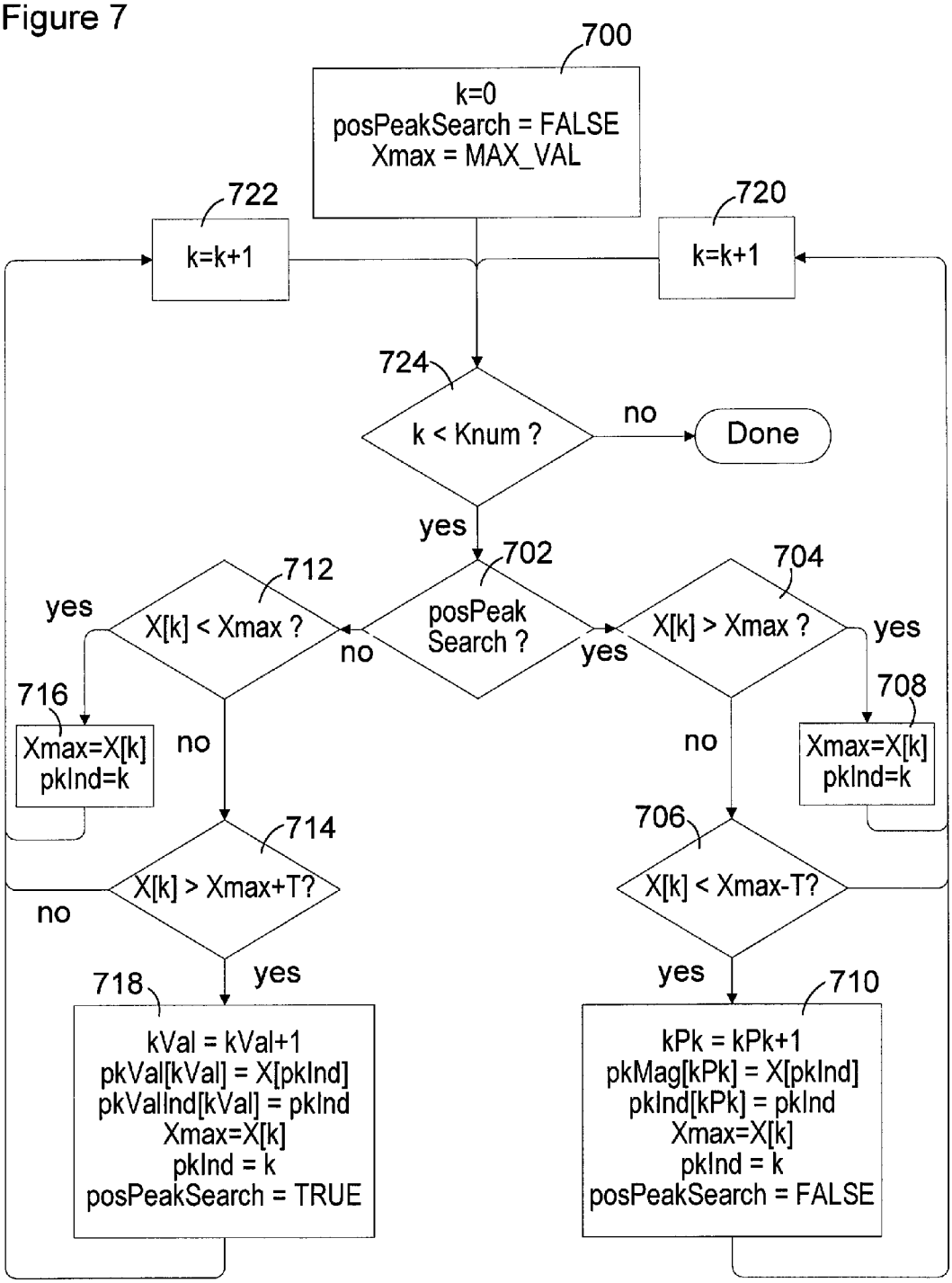
FIG. 7 is a block diagram of a representative peak detector.

The spectral peak picker, as shown in FIG. 6, takes in a dB spectrum and produces peak data consisting of numPeak—the number of peaks (max 120) found in the spectrum pkNote—a vector of length 120 giving the note number of the peak centers pkMag—a vector of length 120 giving the magnitude in dB of each peak pkMagRel—a vector of length 120 giving the magnitude in dB relative to the maximum magnitude in the spectrum pkQ—a vector of length 120 giving a quality measure for the peak The spectrum is first processed by the peak detector (600), which is shown in flowchart form in FIG. 7, with Knum=512, and threshold T=0.1 dB. This algorithm gives pkMag and pkInd for all the positive peaks in the spectrum, and pkVal and pkInd for all the negative peaks. Given the nature of the peak detector, a positive peak is always straddled by a negative peak on each side (except possibly at the ends), which makes it possible to compute the peak to valley ratio for each positive peak as $$pkVal\mathrm{Ratio}(k)=pkMag(k)-0.5(pkVal(i)+pkVal(i+1)) \tag{6}$$

where pkVal(i) is the negative peak just before pkMag(k), and pkVal(i+1) is the negative peak just after pkMag(k). For the end conditions, if a negative peak does not exist, the magnitude of the one negative peak is used instead of taking an average.

Setting maxMag to the maximum magnitude in the spectrum, the relative magnitude of each peak can be computed as follows:

$$pkMagRel(k)=pkMag(k)-\max Mag \quad (7)$$

The peak data is then processed by the peak pruner (602), which prunes peaks that have low peak to valley ratio or low relative magnitude. In particular, if a peak has $$pkMagRel(k)<-60 \quad (8)$$

Or $$pkValRatio(k)<4 \quad (9)$$

Then it is removed from the peak list.

The remaining peaks are then processed by the peak quality estimator (604) to compute pkQ(k) for each peak as $$pkQ(k)=0.5*(pkQ1(k)+pkQ2(k)) \quad (10)$$

where $$pkQ1(k)=pkMagRel(k)-(-60) \quad (11)$$

$$pkQ1(k)=pkQ1(k)/\max(pkQ1) \quad (12)$$

and $$pkQ2(k)=\min(pkValRatio(k)/30,1) \quad (13)$$

Finally, given that the spectral resolution of our spectrum is $\Delta f=44100/16/1024=2.69$ Hz, the frequency of each peak can be computed as $f(k)=pkInd(k)\times\Delta f$, and the peak note numbers, pkNote(k), can be computed using Equation 1.

Note Estimator

Figure 8:
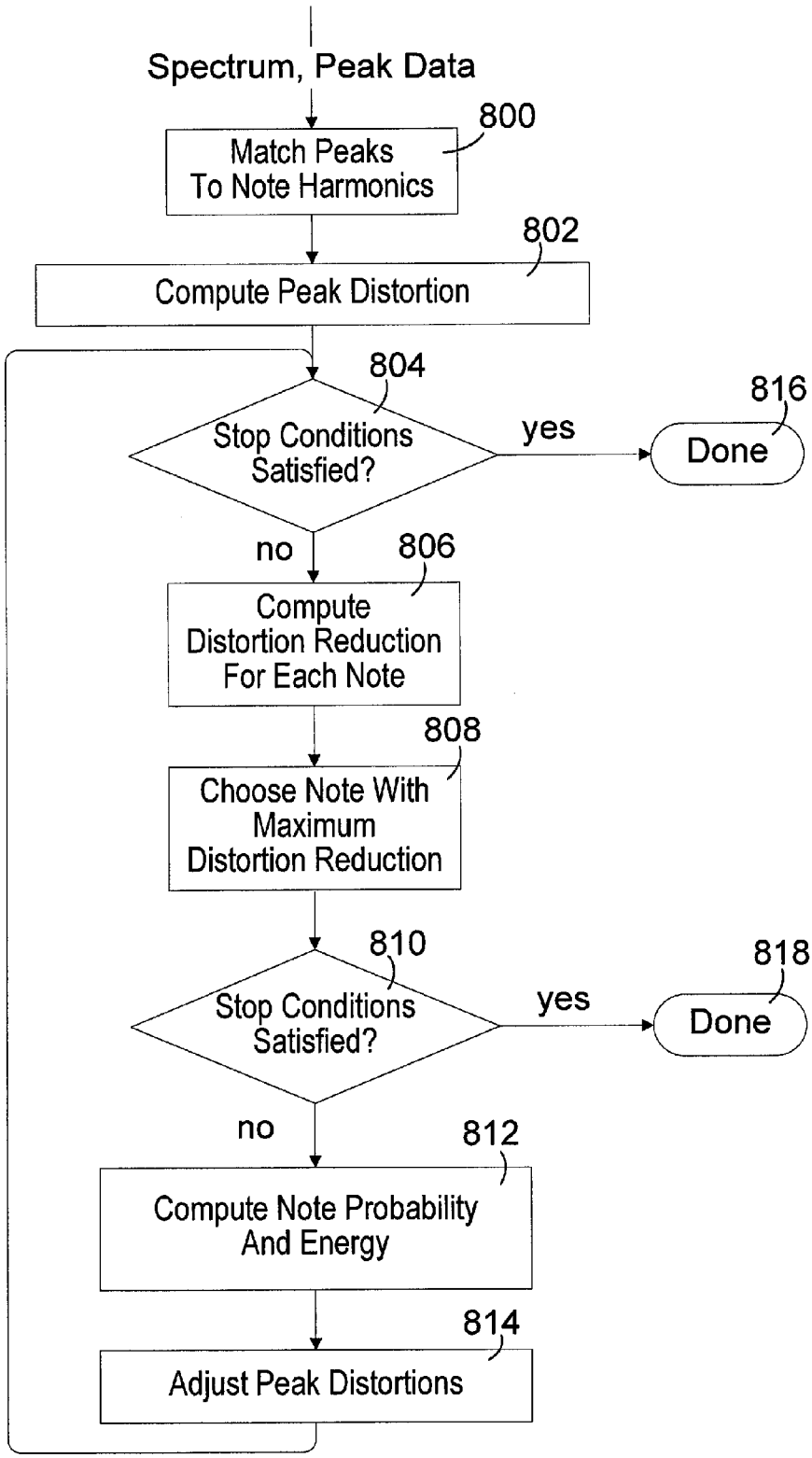
FIG. 8 is a block diagram of a representative note estimator that receives Peak Data, numPeaks, pkNote(k), pkMag(k), pkQ(k) and produces note probability estimates P(k) and note energy estimates E(k) for note numbers 0-127.

The note estimator, as shown in FIG. 8 in flowchart form, takes in peak data, numPeaks, pkNote(k), pkMag(k), pkQ(k) and produces note probability estimates P(k), and note energy estimates E(k) for note numbers 0-127.

The peak data is first processed by process 800, which matches the peaks to expected harmonic locations of notes. For each note, the expected locations of its harmonics can easily be computed using the inverse of Equation 1, which results in $$f(n, j) = j \times \frac{2^{(n-69)/12}}{f_{ref}} Hz, \quad (14)$$

wherein n is the note number, j is the harmonic number (1 corresponds to fundamental). The expected location of each harmonic peak as a note number, N(n, j), can then be computed using Equation 1.

Given the expected note numbers of harmonic peaks and the actual spectral peak locations pkNote(k), a spectral peak is assigned to an expected harmonic location if $$abs(pkNote(k)-N(n,j))<0.5 \quad (15)$$

If a match is found, then the match quality is computed as $$M(n,j,k)=1-abs(N(n,j)-pkNote(k)/0.5)^2 \quad (16)$$

where n is the note number, j is the harmonic number and k is the peak number. If a matching spectral peak is not found at an expected harmonic location, then a penalty is computed as $$P(n,j)=(\min(\max(S(i))-S(i),40)/40)^2 \quad (17)$$

where i is the expected spectral index of the harmonic peak, and S(i) is the spectral value at that index. This formulation penalizes more if the expected location of the harmonic has low energy relative to the max in the spectrum.

The peak distortion is then computed in process 802 as $$pkD(k)=pkQ(k)wN(k) \quad (18)$$

where wN(k) is a weight that is computed for the spectral peak based on its note number. The exact weighting is not critical and may need to be adjusted depending on the specific kinds of input instruments expected. In the case of a guitar input, the following linear interpolation look-up table gives good results.

TABLE 4

Note number weighting

| pkNote (k) | wN (k) |
|---|---|
| 0 | 0 |
| 37 | 0 |
| 38 | 0.3 |
| 40 | 1 |
| 52 | 1 |
| 64 | 1 |
| 76 | 1 |
| 80 | 0.3 |
| 89 | 0.05 |
| 127 | 0 |

Once the spectral peaks have been matched to note harmonics and the peak distortion has been computed, the note picking loop is ready to begin. The first decision (804) in the loop checks to see if the maximum number of notes has already been selected and stops the loop if they have. The maximum number of notes will vary depending on the type audio input, but for guitar, setting the maximum number of notes to 6 produces good results. Process 806 computes the distortion reduction for each note as $$DR(n) = \sum_{j=k} M(n, j, k)pkD(k)wH(j) - \sum_{j} P(n, j)wH(j) \quad (19)$$

where M(n, j,k), pkD(k) and P(n,j) were described above and wH(j) is a harmonic weighting function given by

TABLE 5

Harmonic Number Weighting

| Harmonic Number | wH |
|---|---|
| 1 | 0.5 |
| 2 | 0.4 |
| 3 | 0.25 |
| 4 | 0.2 |
| 5 | 0.15 |
| 6 | 0.1125 |
| 7 | 0.1 |
| 8 | 0.05 |
| 9 | 0.05 |
| 10 | 0.05 |
| 11 | 0.05 |
| 12 | 0.05 |
| 13 | 0.05 |
| 14 | 0.05 |
| 15 | 0.05 |
| 16 | 0.05 |

The DR value for a note will be high if several of the expected locations of its harmonics match spectral peaks well and there are relatively few harmonics that didn't find a matching peak.

Process 808 then selects the note that has the largest distortion reduction, but a few checks are done before accepting the note. If a spectral peak was not found to match the fundamental of the note, or the maximum relative magnitude, pkMagRel, of all the peaks matching the fundamental is less than −30 dB, then the note is rejected, its distortion reduction is set to 0, and the note giving the next highest distortion reduction is analyzed. This analysis is continued until a valid note is found.

Similarly, we want to avoid picking notes that have a high distortion reduction due to several poorly matched peaks or where the peaks that were matched have low peak distortion. Let the peak distortion drops be defined as $$pkD\text{drop}(n,j,k)=M(n,j,k)*pkD(k) \tag{20}$$

A check is done to make sure that $$\max_j(pkDdrop(n,\ j,\ k)) > 0.35.$$

If not, then the note is discarded, its DR value is set to zero and the note with the next largest DR value is analyzed. This analysis is continued until a valid note is found.

In decision 810 the following stop condition is tested:

$$\max(\text{DR})<0.2 \tag{21}$$

where max(DR) is the distortion reduction of the note that we chose. If this condition is satisfied, then there are no more important notes to be extracted, and we can stop searching. If this condition fails, then we compute the note probability as $$P(nPick) = \sum_{j,k} M(nPick,\ j,\ k)pkQ(k)wH(j) - \sum_j P(nPick,\ j)wH(j) \tag{22}$$

and the note energy as $$E(n\text{Pick})=pkMag(k\text{Fund}) \tag{23}$$

where nPick is the index of the note that we selected, and kFund is the index of the peak associated with the fundamental of the note. More harmonics could be used to estimate the note energy, but it was found that using only the fundamental worked sufficiently well for this application.

The last step in this loop is process 814 which adjusts the peak distortions to account for the fact that we have selected a note. This is done using the following equation $$pkD(k) = pkD(k) - \max_j(pkDdrop(nPick,\ j,\ k)) \tag{24}$$

which reduces the distortion of the peaks that can be accounted for by the note that was just selected.

Note Interpreter

Figure 9:
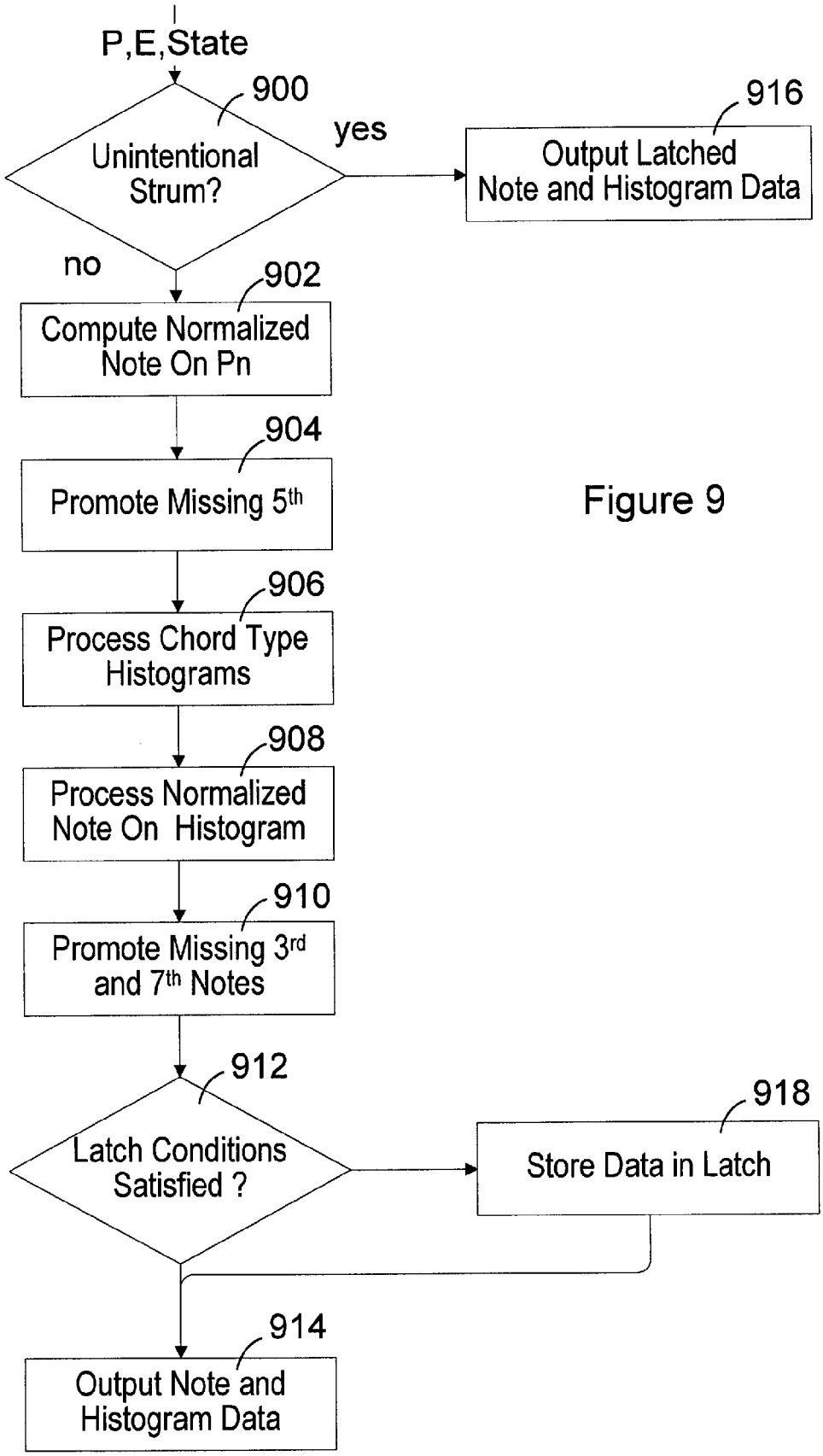
FIG. 9 is a block diagram of a note interpreter that receives note probabilities P and note energies E and produces modified note probabilities Pm, a normalized note vector Pn, and a normalized note histogram Hn.

The note interpreter, as shown in flowchart form in FIG. 9, takes in note probabilities, P, and note energies, E, and produces modified note probabilities, Pm, a normalized note vector, Pn, and a normalized note histogram Hn.

The first decision 900 determines if the notes being played represent an unintentional strum. If an unintentional strum is detected, then process 916 causes the last latched note and histogram data to be output, which is usually the last strummed chord. The logic that determines when to store the latch data is described below for process 912.

If an unintentional strum is not detected, then process 902 computes the normalized note vector from the input note probabilities P(n). The index into the normalized note vector from the input note vector can be computed as $$nn=\text{mod}(n,12) \tag{25}$$

where mod is the modulus operator defined as $$\text{mod}(x,y)=x-\text{floor}(x/y)*y \tag{26}$$

The computation of Pn(nn) involves finding the maximum P(n) value for all n that map to nn, and setting Pn(nn) to 1 if this value is greater than 0.75, and 0 otherwise. The threshold of 0.75 is not critical, but was found to work well for guitar signals.

Process 904 analyzes the normalized note vector and adds a fifth if a fifthless chord voicing is detected. If only two notes are on, then for each note, the algorithm checks to see if the other note is 3 (minor third) or 4 (major third) semi-tones up (mod 12), and if it is, then a note 7 semitones up (mod 12) is added to the normalized note vector. The mod 12 is necessary to wrap the logic around the end of the normalized note vector. For example, 4 semi-tones up from normalized note number 10 is normalized note number 2. If three notes are on, then for each note, the algorithm checks to see if one of the other notes are 3 or 4 semi-tones up (mod 12) and the third note is 10 (dom 7) or 11 (maj 7) semi-tones up (mod 12), and if they are, then a note 7 semi-tones up (mod 12) is added to the normalized note vector.

Process 906 sets up and runs the chord histograms which are used later in process 910. There are four chord type histograms which are computed and stored, min $3^{rd}$, maj $3^{rd}$, dom 7, and maj 7 for each of the 12 normalized notes. The following table shows the conditions required to hit each histogram for normalized note number 0.

TABLE 6

Chord Type Histogram Conditions

| Normalized Note Number | | | | | | | | | | | | | |
|---|---|---|---|---|---|---|---|---|---|---|---|---|---|
| 0 | 1 | 2 | 3 | 4 | 5 | 6 | 7 | 8 | 9 | 10 | 11 | N | Histogram |
| x | | | x | | | | x | | | | | 3 | min $3^{rd}$ |
| x | | | x | | | | x | | | x | | 4 | min $3^{rd}$, dom 7 |
| x | | | x | | | | x | | | | x | 4 | min $3^{rd}$, maj 7 |
| x | | | | x | | | x | | | | | 3 | maj $3^{rd}$ |
| x | | | | x | | | x | | | x | | 4 | maj $3^{rd}$, dom 7 |
| x | | | | x | | | x | | | | x | 4 | maj $3^{rd}$, maj 7 |
| x | | | | | | | x | | | x | | 3 | dom 7 |
| x | | | | | | | x | | | | x | 3 | maj 7 |

where the same patterns are searched for (mod 12) for the other note numbers. This table is used as follows. The first row indicates that if normalized note 0, 3 and 7 are on, and there are only 3 notes on, then increment the min $3^{rd}$ histogram. The second row indicates that if normalized note 0, 3, 7 and 10 are on, and there are only 4 notes on, then increment the min $3^{rd}$ and dom 7 histogram. The remaining rows work in a similar way.

The chord histograms work as follows. For each chord type there are 12 bins representing the normalized note number. If a chord type is detected for a given normalized note using the above logic, then this histogram bin is incremented by 1, but otherwise it is not incremented. All the histogram bins are then processed by a first order IIR filter of the form $$y[n]=(1-a)x(n)+a*y(n-1) \quad (27)$$

where a is chosen to give a suitable decay time. In our system, a was set to 0.9982 for the maj $3^{rd}$ and min $3^{rd}$ histograms, and 0.982 for the dom 7 and maj 7 histograms.

Process 908 processes the normalized note histogram Hn, which is a 12 bin histogram that keeps track of the relative frequency that each note has been played in the recent past. If a normalized note is on, then its bin is incremented by 1, and otherwise it is not incremented. Each bin is then processed using Equation 27 with a=0.9982.

Process 910 uses the chord type histograms computed by process 906 to promote missing $3^{rd}$ and $7^{th}$ notes. The conditions to promote 3rds or 7ths are given in the following table for normalized note 0.

TABLE 7

Note Promotion conditions

| Normalized Note Number | | | | | | | | | | | | | |
|---|---|---|---|---|---|---|---|---|---|---|---|---|---|
| 0 | 1 | 2 | 3 | 4 | 5 | 6 | 7 | 8 | 9 | 10 | 11 | N | Promotion |
| x | | | | | | | x | | | | | 2 | $3^{rd}$, $7^{th}$ |
| x | | | | | | | x | | | x | | 3 | $3^{rd}$ |
| x | | | | | | | x | | | | x | 3 | $3^{rd}$ |
| x | | | x | | | | x | | | | | 3 | $7^{th}$ |
| x | | | | x | | | x | | | | | 3 | $7^{th}$ |

where the same patterns are searched for (mod 12) for the other note numbers. This first row of this table indicates that if normalized note 0 and normalized note 7 are on and there are only 2 notes on, then the $3^{rd}$ and the $7^{th}$ will be promoted if further conditions described below are satisfied. The second row indicates that if normalized note 0, 7 and 10 are on, and there are 3 notes on, then the $3^{rd}$ will be promoted, etc.

In case of $3^{rd}$ promotion, the following logic is used to decide whether to promote the maj $3^{rd}$, or the min $3^{rd}$. If the maj $3^{rd}$ histogram of the normalized note under consideration is greater than or equal to the min $3^{rd}$ histogram and also greater than a minimum threshold (0.0025), then the maj $3^{rd}$ is added to the normalized note list. Otherwise if the min $3^{rd}$ histogram of the normalized note under consideration is greater than or equal to the maj $3^{rd}$ histogram and also greater than a minimum threshold (0.0025), then the min $3^{rd}$ is added to the normalized note list. Otherwise if the normalized note histogram, Hn, for the note corresponding to the maj $3^{rd}$ is greater than the note corresponding min $3^{rd}$ and also greater than some minimum threshold (0.05), then the maj $3^{rd}$ is added to the normalized note list. Otherwise if the normalized note histogram, Hn, for the note corresponding to the min $3^{rd}$ is greater than the note corresponding maj $3^{rd}$ and also greater than some minimum threshold (0.05), then the min $3^{rd}$ is added to the normalized note list. Otherwise, the maj $3^{rd}$ is added to the normalized note histogram.

In the case of $7^{th}$ promotion, the following logic is used to decide on whether to promote the dom 7, maj 7 or neither. If the dom 7th histogram of the normalized note under consideration is greater than or equal to the maj 7th histogram and also greater than a minimum threshold (0.0025), then the dom 7th is added to the normalized note list. If the maj 7th histogram of the normalized note under consideration is greater than or equal to the dom 7th histogram and also greater than a minimum threshold (0.0025), then the maj 7th is added to the normalized note list. If neither of these conditions is TRUE, then the $7^{th}$ is not promoted.

Finally, decision 912 checks to see if the input state is greater than or equal to 3 and if it is, then the note probability vector Pm, and the normalized note vector Pn are stored in the latch memory, as indicated by process 918.

Unintentional Strum

The purpose of the unintentional strum detector is to determine if a strum is intentional or if it was a consequence of the user's playing style and not intended to be interpreted as a chord. Typically, when a person strums the strings of their guitar, there is a noise burst as the pick or their fingers strike the strings. At this time the audio spectra contains very little information about the underlying notes being played and the note detection state goes to zero. As the strings start to ring out after the strike, the state increases until either the strings ring out, or another strum occurs. In this sense, a strum can be defined as the time between two zero states. The unintentional strum detector analyzes the audio during a strum and decides whether to accept the strum or ignore it.

The first condition that gets classified as an unintentional strum is if the energy of the strum is 12 dB or more below the maximum note energy in the previous strum. This is used to ignore apparent strums that can be detected when a player lifts their fingers off the strings, or partly fingers a new chord but hasn't strummed the strings yet.

The second condition that gets classified as an unintentional strum is if the maximum note probability is below 0.75. This used to ignore strums where the notes in the chord are not well defined.

The third condition that gets classified as an unintentional strum is an open strum, which often occurs between chords as the player lifts their chord fingers off the strings and repositions them on the next chord. During this short period of time, a strum can occur on the open strings (e.g. EADGBE on a normally tuned guitar without a capo) which is not intended to be part of the song. A method has been developed to detect and ignore open strums or other unintentional note patterns which will be disclosed here.

The following table shows the intervals that are used in the current system for detecting open strums.

TABLE 8

Open strum interval patterns

| Pattern Number | Pattern Interval Vector |
|---|---|
| 1 | 5, 5, 5, 4, 5 |
| 2 | 5, 5, 5, 4 |
| 3 | 5, 5, 4, 5 |
| 4 | 5, 5, 5 |
| 5 | 5, 5, 4 |
| 6 | 5, 4, 5 |
| 7 | 5, 5 |

These intervals are searched for in the incoming note probabilities, where a note is considered on if P(n)>=0.75. Intervals are used instead of absolute notes to make the logic work even if a capo is used (a capo is bar that is attached to the guitar neck in order to change the tuning of all the string of the guitar by the same interval). The intervals listed in the table were chosen based on standard EADGBE guitar tuning to give the highest probability of detecting these open strums, while at the same time minimizing the probability of falsely detecting an open strum when a real strum was intended by the user. While these patterns were found to work well for guitar, clearly other patterns could be added or removed to accommodate different tunings, instruments or false positive detection rates.

The conditions and specific numbers described above work well for detecting unintentional guitar strums, but it should be clear to one skilled in the art that other conditions and numbers could easily be implemented as well. In some examples, notes form the unintentional strum are replaced with a null set of notes so that the unintentional strum is not sounded.

Harmony Logic Overview

The harmony logic (206) determines harmony notes that will be musically correct in the context of the current set of accompaniment notes provided by the note merger (204). A method of choosing harmony notes to go with a melody note starts with a process of constructing chords, of which the melody note is a member. For example, if two voices of harmony are needed, both above the melody, then for each melody note we construct a chord with the melody as the lowest note of the chord.

A goal is to construct chords whose notes blend well (are consonant) with (roughly in order of importance):

the melody
the current accompaniment
each other
the overall song

Chords can be completely described in terms of their intervals, the distances from one note to an adjacent (or other) note in the chord. We pick a set of chords (which, depending on the desired harmony style, may be as simple as the major and the minor, or may include more complicated chords like 7th, minor 7th, diminished, 9th etc.) and we analyze them to determine their frequency of usage of each interval. For the simplest set of chords listed above (i.e. major and minor), the intervals between a note and the note above are +3, +4 and +5. The intervals between a note and the note 2 above it are +7, +8 and +9.

It should be noted that the use of this simple set of chords is just one example out of many possibilities which include more complex chords.

Now given:

the melody
the accompaniment notes
the history of the melody and accompaniment within the song musically correct harmonies can be constructed as follows:

1. Examine the accompaniment notes at the specified range of intervals from the melody note, and if one or more accompaniment notes are found in that range, choose one (if more than one matches, use a weighting criterion to select one)
2. Otherwise, for each note in the range of intervals, examine the intervals between it and all accompaniment notes, and if those intervals are dissonant enough, remove the note from further consideration. Then examine the song history and choose the notes within the remaining range of intervals that:
   - has the best probability of fitting into the song's history, and
   - has the best probability of fitting with the melody and all the other harmony notes chosen so far in this harmony "chord"
3. Repeat the above steps for each voice of harmony.

Melody Tracking

The procedure as described above places little weight on the melody note immediately preceding the melody note of interest. However, in many harmony styles the quality of harmony can be improved by imposing an additional time-varying weighting function which favors selection of a harmony note that is above or below the previous harmony note, depending on whether the melody note is above or below the previous melody note, respectively. This may be accomplished by reducing the weighting applied to specific intervals, or by restricting the interval (a special case of the above, in which the weighting for some intervals is set to zero). Note that this can result in harmonies that are dissonant with respect to the accompaniment, however because this is done deliberately and only under specific conditions, it can create harmonies that are more interesting.

A specific example of this general algorithm, which gives good results for many modern songs, is described below:

Harmony Logic

Figure 11:
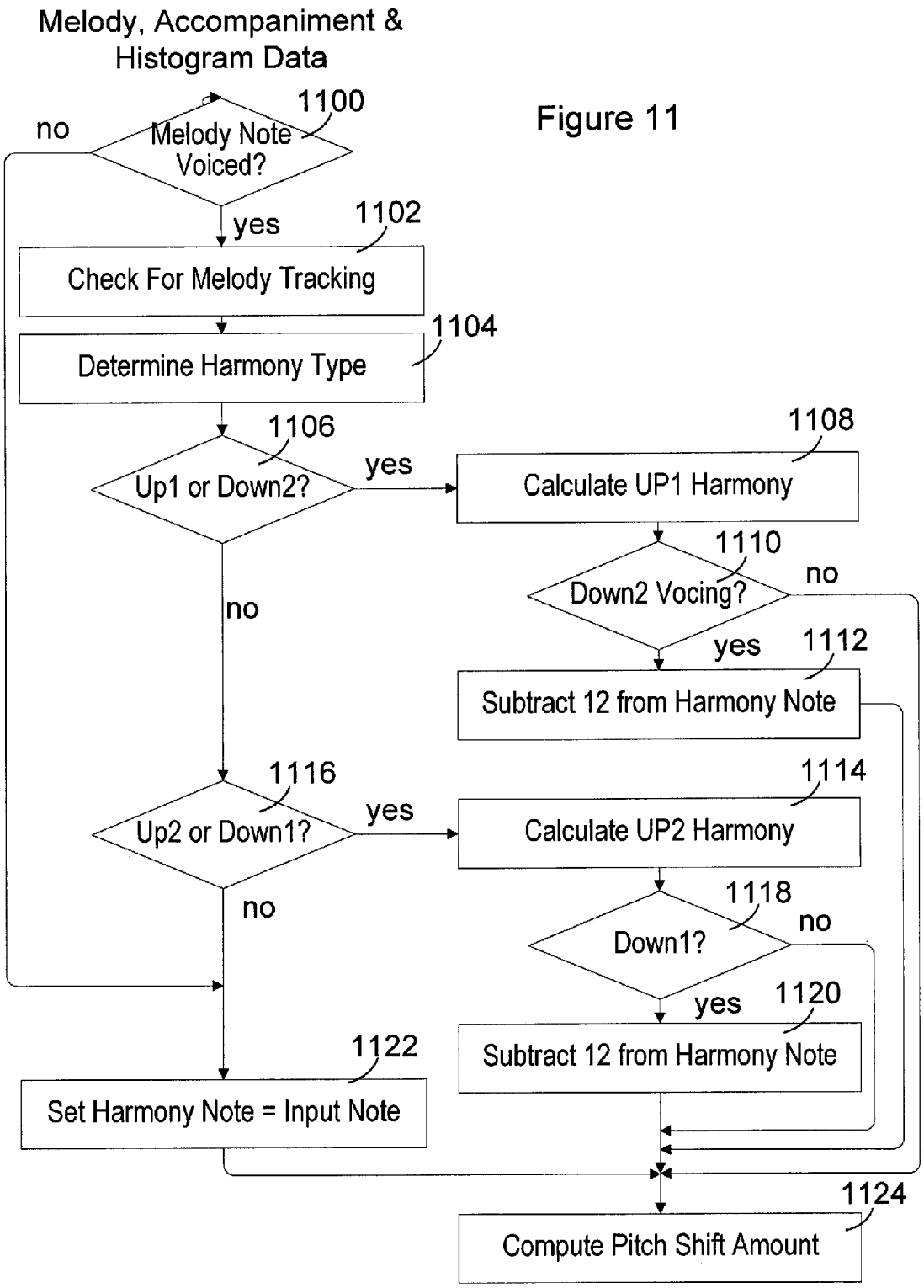
FIG. 11 is a block diagram of a representative harmony logic block configured to estimate a pitch shift.

The harmony logic (206) takes as input the quantized melody note and note stability information, melody voicing flag, the accompaniment notes, and the note histogram data, and returns the set of harmony notes. The harmony notes are expressed as a pitch shift amount which is the note number of the input melody note subtracted from the note number of the harmony notes. This note difference can be converted to a shift ratio $$r=2^{-(nh-nm)/12} \tag{28}$$

where nh is the harmony note number, nm is melody note number, and r is the shift ratio which is the ratio of the harmony pitch period over the melody pitch period. FIG. 11 shows the processing flow of this block. First, the voicing flag is checked (1100), because no shift is required if the input melody is not a voiced signal. Therefore if the melody is currently unvoiced, the harmony note is set to the input note (1122). If the input melody is voiced, we then check to see if we are currently tracking the melody (1102). We consider melody tracking to be TRUE if all the following conditions are met:

- The previously stable note was within 2 semitones of the current note, and
- The previously stable note is not the same as the current note, and
- The time between the end of the previous stable note and the current frame is less than a time tolerance (approximately 1 second in our implementation)

If these conditions are met, we set the melodyTracking flag to be TRUE, otherwise it is set to FALSE. We then proceed to step (1104) where we check to see what type of harmony voicing should be generated. In this disclosure, we describe in detail voicings that are nominally 3, 4, or 5 semitones up or down from the melody note (referred to as UP1 and DOWN1 voicings respectively), because these are the most common voicings. We also generate an UP2 voicing by raising the DOWN1 voicing by one octave, and a DOWN2 voicing by lower the UP1 voicing by one octave. It will be appreciated by those skilled in the art that other voicings can be generated in a similar manner to the ones described below.

If the requested harmony (from the user interface, for example) is either UP1 or DOWN2 (1106), we proceed to (1108) where we calculate the harmony note corresponding to a UP1 shift. Once the harmony note is generated, we check to see if the requested harmony was DOWN2 (1110). If not, we proceed to (1124). Otherwise, we first subtract 12 semitones from the calculated harmony to convert it from UP1 to DOWN2 (1112) before proceeding to (1124).

Similarly, if at step (1106) the harmony choice was not UP1 or DOWN2, we test for the case of DOWN1 or UP2 (1116). If the harmony choice is not one of these, then we assume a unison harmony and set the harmony note equal to the input note (1122), otherwise we proceed to step (1114) to calculate the UP2 harmony. Once the harmony note is generated, we check to see if the requested harmony was DOWN1 (1118). If not, we proceed to (1124) where the pitch shift amount is computed according to Equation 28. Otherwise, we first subtract 12 semitones from the calculated harmony to convert it from UP2 to DOWN1 (1120) before proceeding to (1124). At step (1124) we convert the target harmony note to a pitch shift amount according to Equation 28.

Calculate UP1 Harmony

Figure 12:
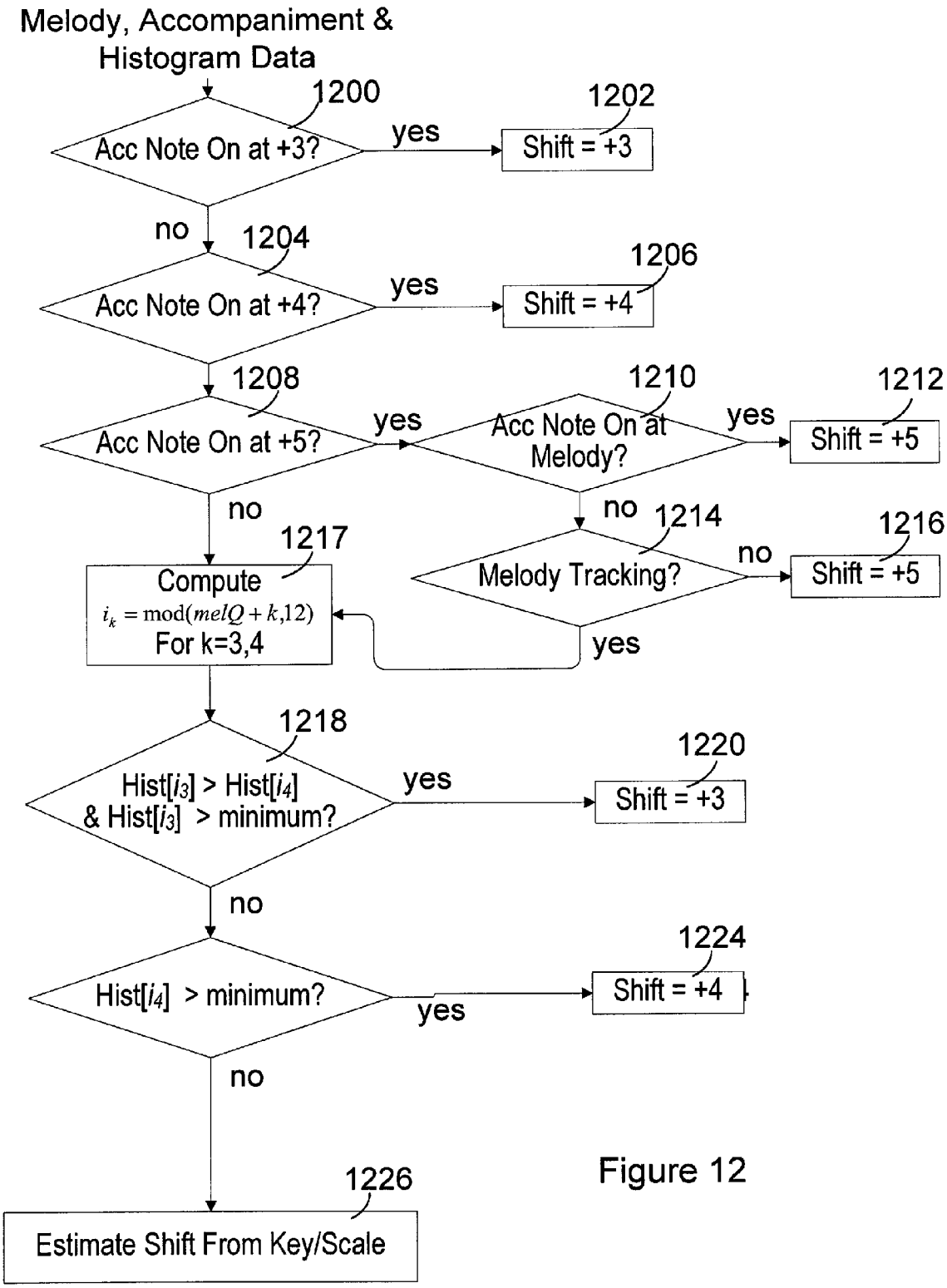
FIG. 12 is a block diagram illustrating a harmony subsystem that is configured to produce a harmony note that is nominally 4 semitones from a melody note, but can vary between 3 semitones and 5 semitones in order to create a musically correct harmony sound.

The Calculate UP1 Harmony subsystem is responsible for producing a harmony note that is nominally 4 semitones from the melody note, but can vary between 3 semitones and 5 semitones in order to create a musically correct harmony sound. The process is described in FIG. 12.

The input to this subsystem is the melody note data which includes the quantized melody note, melody tracking flag, and voicing flag, as well as the accompaniment and histogram data. The accompaniment data is expressed in normalized note form, so that it is easy to determine whether the input melody note has a corresponding note on in the accompaniment without regard to octave. First, the normalized accompaniment notes are checked to see if a note is present 3 semitones up from the input melody note (1200). If this is the case, we simply set the harmony shift to be +3 semitones (1202). Otherwise, we apply the same test for an accompaniment note that 4 semitones up from the input melody note (1204). If we find an accompaniment note here, we simply set the harmony shift to be +4 semitones (1206).

If we make it to step (1208) it is because there were no accompaniment notes either 3 or 4 semitones above the input note. At this step, we look for an accompaniment note that is 5 semitones above the input melody note. If this note is not found, we jump to step (1217). Otherwise, if this note is found, then we determine if the melody note is also found in the accompaniment note set (1210). If this is TRUE, we set the harmony shift to +5 semitones (1212). Otherwise, we proceed to step (1214) where we look at the melody tracking flag that was calculated in the Harmony Logic block (206). If melody tracking is FALSE, we set the harmony shift to be +5 semitones (1216). Otherwise, if we are melody tracking, we proceed to step (1217). At step (1217) we look at the histogram representing past accompaniment note data to try and determine the musically correct shift ratio. To find the index into the histogram for a note that is k semitones up from the melody note nm, the following equation is used:

$$iHist_k = \mathrm{mod}(nm+k, 12) \tag{29}$$

In step (1218), $iHist_3$ and $iHist_4$ are calculated using Equation 29. If the histogram energy at $iHist_3$ is larger than the histogram energy at $iHist_4$ then the +3 harmony shift is chosen (1220) as long as the histogram energy is considered valid at $iHist_3$. To be considered valid, the energy of the histogram in any bin must be greater than 5% of the maximum value over all histogram bins. If one of these tests is not met, the processing proceeds to step (1222) where the histogram validity is checked at $iHist_4$. If a valid histogram energy is found here, the harmony shift is set to +4 semitones (1224).

Otherwise, the harmony is estimated based on the current key/scale guess (1226). A detailed explanation of computing the harmony note based on key and scale guessing is provided below.

Calculate UP2 Harmony

The calculate UP2 Harmony subsystem is responsible for producing a harmony note that is nominally 7 semitones from the melody note, but can vary between 6 semitones and 9 semitones in order to create a musically correct harmony sound. The process is described in FIG. 13.

The input to this subsystem is the melody note data which includes the quantized melody note, melody tracking flag, and voicing flag, as well as the accompaniment and histogram data. The accompaniment data is expressed in normalized note form, so that it is easy to determine whether the input melody note has a corresponding note on in the accompaniment without regard to octave. First, we check to see if the accompaniment notes include the melody note as well as the note 6 semitones up from the melody (1300). If this is the case, we set the harmony shift to be +6 semitones (1302). Otherwise, we look for an accompaniment note that is 7 semitones above the input melody note. If this note is not found, we jump to step (1314). Otherwise, if this note is found, then we determine if the melody note is also found in the accompaniment note set (1306). If this is TRUE, we set the harmony shift to +7 semitones (1308). Otherwise, we proceed to step (1310) where we look at the melody tracking flag that was calculated in the Harmony Logic block (206). If melody tracking is FALSE, we set the harmony shift to be +7 semitones (1312). Otherwise, if we are melody tracking, we proceed to step (1314).

At step (1314), the normalized accompaniment notes are checked to see if a note is present 8 semitones up from the input melody note. If this is the case, we simply set the harmony shift to be +8 semitones (1316). Otherwise, we apply the same test for an accompaniment note that is 9 semitones up from the input melody note (1318). If we find an accompaniment note here, we simply set the harmony shift to be +9 semitones (1320).

Otherwise, we proceed to step (1319) where we look at the histogram representing past accompaniment note data to try and determine the musically correct shift ratio. First, $iHist_8$ and $iHist_9$ are calculated using Equation 29. If the histogram energy at $iHist_8$ is larger than the histogram energy at $iHist_9$ (1322) then the +8 harmony shift is chosen (1220) as long as the histogram energy is considered valid at $iHist_8$. To be considered valid, the energy of the histogram in any bin must be greater than 5% of the maximum value over all histogram bins. If one of these tests is not met, the processing proceeds to step (1324) where the histogram validity is checked at $iHist_9$. If a valid histogram energy is found here, the harmony shift is set to +9 semitones (1328). Otherwise, the harmony is estimated based on the current key/scale guess (1330).

Compute Harmony Note from Key and Scale

This section describes the method used to compute a harmony note that is based on an estimate of the current key (e.g. C, C#, . . . B), and scale (major or minor). First, we define two reference templates, Tmj(k) and Tmn(k), where k is the normalized note number. Tmj(k) is an estimate of the probability that a note from a song in the key of C major will be present in the melody. Tmnj(k) is an estimate of the probability that a note from a song in the key of C minor will be present in the melody. By circularly rotating these templates and comparing them to the normalized note histograms obtained in the Note Interpreter block (308), it is possible to come up with an estimate of the key and scale as follows:

First, we find the mean squared error in guessing that the key corresponds to the major scale of note k as follows:

$$Errmj_k = \sum_{j=0}^{11} [(Hn(\mathrm{mod}(j+k, 12)) - Tmj(k)]^2 \tag{30}$$

where Hn(k) is the kth value of the normalized note histogram. Similarly, we find the mean squared error in guessing that the key corresponds to the minor scale of note k as follows:

$$Errmn_k = \sum_{j=0}^{11} [(Hn(\mathrm{mod}(j+k, 12)) - Tmn(k)]^2 \tag{31}$$

where Hn(k) is the kth value of the normalized note histogram. We then choose the key and scale by finding the minimum of $Errmj_k$ and $Errmn_k$ over all k.

In our system, the values used for the templates are:

$$Tmj=[1,0,0.5,0,0.7,0.3,0,0.75,0,0.55,0.1,0.25] \tag{32}$$

$$Tmn=[1,0,0.6,0.9,0.0,0.6,0,0.85,0.2,0,0.35,0.1] \tag{33}$$

Once we have estimated the key and scale, we can then choose the best harmony note using pre-stored tables that are designed using a priori analysis of note probabilities. To use the tables, we first normalize the melody note to the key of C. For example, if the melody note is an F (note 5) and the estimated key is D (note 2), the normalized melody note would be 5−2=3. We would then look up our desired harmony note in either the major or minor shift tables using the normalized melody note to select the column, and the nominal harmony shift to select the row.

TABLE 9

Major Shift Table

| | 0 | 1 | 2 | 3 | 4 | 5 | 6 | 7 | 8 | 9 | 10 | 11 |
|---|---|---|---|---|---|---|---|---|---|---|---|---|
| UP1 | 4 | 3 | 3 | 3 | 3 | 4 | 4 | 4 | 3 | 3 | 4 | 3 |
| UP2 | 7 | 8 | 9 | 8 | 8 | 9 | 9 | 9 | 8 | 8 | 8 | 8 |
| Unison | 0 | 0 | 0 | 0 | 0 | 0 | 0 | 0 | 0 | 0 | 0 | 0 |

TABLE 10

Minor Shift Table

| | 0 | 1 | 2 | 3 | 4 | 5 | 6 | 7 | 8 | 9 | 10 | 11 |
|---|---|---|---|---|---|---|---|---|---|---|---|---|
| UP1 | 3 | 3 | 3 | 4 | 3 | 3 | 3 | 3 | 4 | 4 | 4 | 3 |
| UP2 | 7 | 8 | 8 | 7 | 7 | 7 | 7 | 7 | 7 | 7 | 7 | 7 |
| Unison | 0 | 0 | 0 | 0 | 0 | 0 | 0 | 0 | 0 | 0 | 0 | 0 |

Shifter

The shifter block (104) is responsible for shifting the pitch of the input monophonic audio signal (melody signal) according to the pitch shift amounts supplied by the Harmony Shift Generator block (102) in order to create pitch shifted audio harmony signals. There are several methods for shifting the pitch of an input signal known in the art. For example, resampling a signal at a different rate in combination with cross-fading at intervals which are multiples of the detected pitch period is commonly used for real-time pitch shifting of stringed instrument sounds such as guitars. Pitch Synchronous Overlap and Add (PSOLA) is often used to resample human vocal signals because of the formant-preserving property inherent in the technique as described in Keith Lent, "An Efficient method for pitch shifting digitally sampled sounds," Computer Music Journal 13:65-71 (1989). A form of PSOLA disclosed in U.S. Pat. No. 5,301,259 can be used for the shifter in a representative system.

As shown above, audio processing systems are conveniently based on dedicated digital signal processors. In other examples, other dedicated or general purpose processing systems can be used. For example, a computing environment that includes at least one processing unit and memory configured to execute and store computer-executable instructions. The memory can be volatile memory (e.g., registers, cache, RAM), non-volatile memory (e.g., ROM, EEPROM, flash memory, etc.), or some combination of the two. The processing system can include additional storage, one or more input devices, one or more output devices, and one or more communication connections. The additional storage can be removable or non-removable, and includes magnetic disks, magnetic tapes or cassettes, CD-ROMs, CD-RWs, DVDs, or any other medium which can be used to store information and which can be accessed. The input device(s) may be a touch input device such as a keyboard, mouse, pen, or trackball, a voice input device, a scanning device, or other devices. For audio, the input device(s) can be a sound card or similar device that accepts audio input in analog or digital form, or a CD-ROM reader that provides audio samples to the computing environment. The disclosed methods can be implemented based on computer-executable instructions stored in local memory, networked memory, or a combination thereof.

In additional examples, hardware-based filters and processing systems can be include. For example, tunable or fixed filters can be implemented in hardware or software.

In the examples described above, input and output audio signals are generally processed and output in real-time (i.e., with delays of less than about 500 ms and preferably less than about 40 ms). For example, an audio signal associated with a vocal performance and a guitar accompaniment are processed so that a vocal harmony can provided along with the vocal with processing delays that are substantially imperceptible. In some examples, one or more audio inputs or output can be produced or received as Musical Instrument Digital Interface (MIDI) files, or other files that contain a description of sounds to be played based on specifications of pitch, intensity, duration, volume, tempo and other audio characteristics. If harmonies are to be stored for later playback (i.e., real-time processing is not required), MIDI or similar representations can be convenient. The MIDI representations can be later processed to provide digital or analog audio signals (time-varying electrical signals, typically time-varying voltages) that are used to generate an audio performance using a audio transducer such as a speaker or an audio recording device. In other examples, one or more harmony notes are determined and an output display device is configured to display an indication of the harmony notes.

While certain representative examples of the disclosed technology are described in detail above, it will be appreciated that these examples can be modified in arrangement and detail with departing from the scope of the disclosed technology. We claim all that is encompassed by the appended claims.

We claim:

1. A musical accompaniment apparatus, comprising:

an accompaniment analyzer configured to identify a spectral content of a received digital accompaniment signal;

a pitch detector configured to identify a current melody note based on a received digital melody signal;

a harmony generator configured to determine at least one harmony note based on the current melody note and the spectral content of the received digital accompaniment signal; and an unintentional strum detector configured to detect an unintentional strum of a multi-stringed musical instrument based on the digital accompaniment signal and coupled to the harmony generator so as to suppress a determination of a harmony note based on the unintentional strum.

2. The apparatus of claim 1, further comprising an analog-to-digital converter configured to produce at least one of the digital melody signal and the digital accompaniment signal based on a corresponding analog melody signal or analog accompaniment signal, respectively.

3. The apparatus of claim 1, wherein the accompaniment analyzer is configured to identify at least one note contained in the digital accompaniment signal.

4. The apparatus of claim 1, wherein the harmony note generator is configured to select the at least one harmony note so as to be consonant with the current melody note and the digital accompaniment signal.

5. The apparatus of claim 1, wherein the harmony generator produces a MIDI representation of the at least one harmony note.

6. The apparatus of claim 1, further comprising an output configured to provide an identification of the at least one harmony note.

7. The apparatus of claim 1, further comprising a mixer configured to receive at least one of a melody signal or an accompaniment signal based on the digital melody signal and the digital accompaniment signal, respectively, and at least one harmony signal based on the at least one harmony note.

8. The apparatus of claim 1, wherein the harmony note generator produces the harmony note by pitch shifting the current melody signal.

9. The apparatus of claim 8, wherein the harmony note generator produces the harmony note substantially in real-time with receipt of the accompaniment signal.

10. The apparatus of claim 1, wherein the harmony note generator includes a synthesizer configured to generate the harmony note substantially in real-time.

11. The apparatus of claim 10, wherein the harmony note generator produces the harmony note substantially in real-time with receipt of the accompaniment signal.

12. The apparatus of claim 1, wherein the harmony generator is configured to produce the harmony note substantially in real-time with the current melody note.

13. The apparatus of claim 1, wherein the digital melody signal is based on a voice signal and the digital accompaniment signal is based on a guitar signal.

14. The musical accompaniment apparatus of claim 1, wherein the harmony generator is configured to determine the at least one harmony note based on the current melody note, the spectral content of the digital accompaniment signal, and at least one of melody note history and accompaniment note history.

15. The apparatus of claim 1, wherein the spectral content of the digital accompaniment signal includes at least one note identified in the digital accompaniment signal.

16. The musical accompaniment apparatus of claim 1, wherein the detected unintentional strum corresponds to open strings associated with a chord change from a first chord to a second chord.

17. A computer-readable medium containing computer executable instructions for a method comprising:

receiving at least one polyphonic electrical signal corresponding to a plurality of notes played on a multi-stringed instrument; and determining, based on the received electrical signal, if the received notes are associated with an unintentional strum of the multi-stringed instrument.

18. A method, comprising, receiving at least one polyphonic electrical signal corresponding to a plurality of notes played on a multi-stringed instrument; and determining, based on the received electrical signal, if the received notes are associated with an unintentional strum of the multi-stringed instrument.

19. The method of claim 18, wherein the unintentional strum is detected by comparing the received notes with at least one set of template notes based on an open string tuning of the multi-stringed musical instrument.

20. The method of claim 18, wherein the detected unintentional strum corresponds to open strings associated with a chord change from a first chord to a second chord.

21. A method, comprising:

receiving at least one electrical signal corresponding to a plurality of notes played on a multi-stringed instrument;

determining, based on the received electrical signal, if the received notes are associated with an unintentional strum of the multi-stringed instrument; and replacing the received notes with a substitute set of notes if an unintentional strum is detected.

22. The method of claim 21, further comprising receiving a melody signal, and providing the substitute set of notes to provide at least one harmony note based on the melody signal.

23. A method, comprising, receiving at least one electrical signal corresponding to a plurality of notes played on a multi-stringed instrument; and determining, based on the received electrical signal, if the received notes are associated with an unintentional strum of the multi-stringed instrument, wherein the unintentional strum is detected by measuring at least one interval between adjacent notes in the received notes, and comparing the at least one interval to intervals associated with at least one note template.

24. An apparatus, comprising:

an audio processor configured to determine a plurality of notes in an input audio signal associated with notes from a plurality of strings; and an unintentional strum detector configured to associate the input audio signal with an unintentional strum based on the plurality of notes.

25. The apparatus of claim 24, further comprising a memory configured to store at least one set of notes corresponding to an open strum, wherein the unintentional strum detector is in communication with the memory and associates the input audio signal with the unintentional strum based on the plurality of notes and the at least one set of notes.

26. The apparatus of claim 24, wherein the detected unintentional strum corresponds to open strings associated with a chord change from a first chord to a second chord.

27. A method, comprising:

receiving an audio signal associated with a melody and an audio signal associated with an accompaniment;

estimating a spectral content of the audio signal associated with the accompaniment audio signal;

identifying a current melody note based on the audio signal associated with the melody;

determining a harmony note based on the spectral content and the current melody note; and detecting an unintentional strum corresponding to open strings associated with a chord change from a first chord to a second chord, wherein the harmony note is determined by suppressing notes associated with the unintentional strum.

28. The method of claim 27, wherein the harmony note is determined based on the spectral content, the current melody note and at least one of melody note history and accompaniment note history.

29. The method of claim 27, further comprising mixing an audio signal associated with the harmony note with at least one of the melody and accompaniment audio signals to form a polyphonic output signal.

30. The method of claim 29, wherein the audio signal associated with the harmony note is produced substantially in real-time with receipt of the current melody note.

31. The method of claim 30, further comprising producing an audio performance based on the received audio signals associated with the melody and the accompaniment, and the harmony note.

32. A musical accompaniment apparatus, comprising, an accompaniment analyzer configured to identify a spectral content of a received polyphonic digital accompaniment signal;

a pitch detector configured to identify a current melody note based on a received digital melody signal different than the accompaniment signal; and a harmony generator configured to determine at least one harmony note based on the current melody note and the spectral content of the received digital accompaniment signal.

33. The apparatus of claim 32, wherein the polyphonic digital accompaniment signal is a stringed instrument signal.

34. The apparatus of claim 33, wherein the polyphonic digital accompaniment signal is a guitar signal.

35. The apparatus of claim 32, further comprising an unintentional strum detector configured to detect an unintentional strum of a multi-stringed musical instrument based on the digital accompaniment signal and coupled to the harmony generator so as to suppress a determination of a harmony note based on the unintentional strum.

36. The apparatus of claim 35, wherein the harmony note generator includes a synthesizer configured to generate the harmony note substantially in real-time.

37. The apparatus of claim 36, wherein the harmony note generator produces the harmony note substantially in real-time with receipt of the accompaniment signal.

38. The apparatus of claim 32, further comprising an analog-to-digital converter configured to produce at least one of the digital melody signal and the digital accompaniment signal based on a corresponding analog melody signal or analog accompaniment signal, respectively.

39. The apparatus of claim 32, wherein the accompaniment analyzer is configured to identify at least one note contained in the digital accompaniment signal.

40. The apparatus of claim 39, further comprising an unintentional strum detector configured to detect an unintentional strum of a multi-stringed musical instrument based on the digital accompaniment signal and coupled to the harmony generator so as to suppress a determination of a harmony note based on the unintentional strum.

41. The apparatus of claim 32, wherein the harmony note generator is configured to select the at least one harmony note so as to be consonant with the current melody note and the digital accompaniment signal.

42. The apparatus of claim 32, wherein the harmony generator produces a MIDI representation of the at least one harmony note.

43. The apparatus of claim 32, further comprising an output configured to provide an identification of the at least one harmony note.

44. The apparatus of claim 32, further comprising a mixer configured to receive at least one of a melody signal or an accompaniment signal based on the digital melody signal and the digital accompaniment signal, respectively, and at least one harmony signal based on the at least one harmony note.

45. The apparatus of claim 32, wherein the harmony note generator produces the harmony note by pitch shifting the current melody signal.

46. The apparatus of claim 45, wherein the harmony note generator produces the harmony note substantially in real-time with receipt of the accompaniment signal.

47. The apparatus of claim 32, wherein the harmony generator is configured to produce the harmony note substantially in real-time with the current melody note.

48. The apparatus of claim 32, wherein the digital melody signal is based on a voice signal and the digital accompaniment signal is based on a guitar signal.

49. The apparatus of claim 32, wherein the harmony generator is configured to determine the at least one harmony note based on the current melody note, the spectral content of the digital accompaniment signal, and at least one of melody note history and accompaniment note history.

50. The apparatus of claim 32, wherein the spectral content of the digital accompaniment signal includes at least one note identified in the digital accompaniment signal.

51. A method, comprising:

receiving an audio signal associated with a melody and a polyphonic audio signal associated with an accompaniment;

estimating a spectral content of the polyphonic audio signal associated with the accompaniment;

identifying a current melody note based on the audio signal associated with the melody; and determining a harmony note based on the spectral content of the polyphonic audio signal associated with the accompaniment and the current melody note.

52. The method of claim 51, wherein the polyphonic digital accompaniment signal is a stringed instrument signal.

53. The method of claim 52, wherein the polyphonic digital accompaniment signal is a guitar signal.

54. The method of claim 51, further comprising mixing an audio signal associated with the harmony note with at least one of the melody and accompaniment audio signals to form a polyphonic output signal.

55. The method of claim 54, wherein the audio signal associated with the harmony note is produced substantially in real-time with receipt of the current melody note.

56. The method of claim 55, further comprising producing an audio performance based on the received audio signals associated with the melody and the accompaniment, and the harmony note.

57. The method of claim 51, wherein the harmony note is determined based on the spectral content, the current melody note and at least one of melody note history and accompaniment note history.

58. The method of claim 51, further comprising detecting an unintentional strum corresponding to open strings associated with a chord change from a first chord to a second chord, wherein the harmony note is determined by suppressing notes associated with the unintentional strum.

59. The method of claim 58, wherein the detected unintentional strum corresponds to open strings associated with a chord change from a first chord to a second chord.

60. One or more computer-readable storage media, the computer-readable storage media not being a propagating signal, having stored thereon computer-executable instructions operable to cause a computer to perform a method comprising:

receiving an audio signal associated with a melody and a polyphonic audio signal associated with an accompaniment;

estimating a spectral content of the polyphonic audio signal associated with the accompaniment;

identifying a current melody note based on the audio signal associated with the melody;

and determining a harmony note based on the spectral content of the polyphonic audio signal associated with the accompaniment and the current melody note.

61. The one or more computer-readable storage media of claim 60, wherein the polyphonic digital accompaniment signal is a stringed instrument signal.

62. The one or more computer-readable storage media of claim 61, wherein the polyphonic digital accompaniment signal is a guitar signal.

63. The one or more computer-readable storage media of claim 60, wherein the method further comprises mixing an audio signal associated with the harmony note with at least one of the melody and accompaniment audio signals to form a polyphonic output signal.

64. The one or more computer-readable storage media of claim 63, wherein the audio signal associated with the harmony note is produced substantially in real-time with receipt of the current melody note.

65. The one or more computer-readable storage media of claim 64, wherein the method further comprises producing an audio performance based on the received audio signals associated with the melody and the accompaniment, and the harmony note.

66. The one or more computer-readable storage media of claim 60, wherein the harmony note is determined based on the spectral content, the current melody note and at least one of melody note history and accompaniment note history.

67. The one or more computer-readable storage media of claim 60, wherein the method further comprises detecting an unintentional strum corresponding to open strings associated with a chord change from a first chord to a second chord, wherein the harmony note is determined by suppressing notes associated with the unintentional strum.

68. The one or more computer-readable storage media of claim 67, wherein the detected unintentional strum corresponds to open strings associated with a chord change from a first chord to a second chord.

* * * * *